US006582895B2

(12) United States Patent
Hanaki et al.

(10) Patent No.: US 6,582,895 B2
(45) Date of Patent: Jun. 24, 2003

(54) SILVER HALIDE PHOTOGRAPHIC EMULSION COMPRISING METHINE COMPOUND AND SILVER HALIDE PHOTOGRAPHIC MATERIAL

(75) Inventors: Naoyuki Hanaki, Kanagawa (JP); Takanori Hioki, Kanagawa (JP); Kiyoshi Morimoto, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/773,689

(22) Filed: Feb. 2, 2001

(65) Prior Publication Data

US 2001/0036607 A1 Nov. 1, 2001

(30) Foreign Application Priority Data

Feb. 2, 2000 (JP) ..... 2000-025590
Mar. 24, 2000 (JP) ..... 2000-084512

(51) Int. Cl.[7] ..... G03C 1/005; G03C 1/494

(52) U.S. Cl. ..... 430/583; 430/570; 430/574; 430/581; 430/584; 430/585; 430/599

(58) Field of Search ..... 430/570, 583, 430/574, 581, 584, 585, 599

(56) References Cited

U.S. PATENT DOCUMENTS 5,449,600 A 9/1995 Inagaki et al. ..... 430/567
6,221,574 B1 * 4/2001 Missfeldt ..... 430/583
6,280,921 B1 * 8/2001 Michael et al. ..... 430/583

FOREIGN PATENT DOCUMENTS

JP 60-205442 10/1985

* cited by examiner

*Primary Examiner*—Geraldine Letscher
(74) *Attorney, Agent, or Firm*—Sughrue Mion, PLLC

(57) ABSTRACT

A silver halide photographic emulsion which comprises at least one methine compound represented by the following formula (I):

(I)

wherein $X^1$ and $X_2$ each represents an oxygen atom, a sulfur atom, a selenium atom, or N—$R^3$, wherein $R^3$ represents a hydrogen atom, a substituted or unsubstituted alkyl group, a substituted or unsubstituted aryl group, or a heterocyclic group; $V^1$ and $V^2$ each represents a monovalent substituent; $n^1$ and $n^2$ each represents 0, 1, 2, 3 or 4; $L^1$, $L^2$ and $L^3$ each represents a methine group; l represents an integer of 0 to 3; M represents a counter ion for balancing electric charge; m represents a necessary number for balancing electric charge; and $R^1$ and $R^2$ each represents a substituted or unsubstituted alkyl group, a substituted or unsubstituted aryl group or a substituted or unsubstituted heterocyclic group, but at least either $R^1$ or $R^2$ represents the alkyl group represented by any of the following formulae:

$R_a=(Qa)_rCO\overline{N}SO_2Raa$ $R_b=(Qb)_sSO_2\overline{N}CORbb$ $R_c=(Qc)_tCO\overline{N}CORcc$ $R_d=(Qd)_uSO_2\overline{N}SO_2Rdd$ $R_e=(Qe)_vX$ wherein Raa, Rbb, Rcc and Rdd each represents an alkyl group, an aryl group, a heterocyclic group, an alkoxyl group, an aryloxy group, a heterocyclyloxy group, or an amino group; Qa, Qb, Qc, Qd and Qe each represents a divalent linking group; X represents $SO_3^-$, $CO_2^-$, or $PO_3^{2-}$; and r, s, t, u and v each represents an integer of 1 or more, but when X represents $SO_3^-$, v represents 1 or 2.

14 Claims, No Drawings

SILVER HALIDE PHOTOGRAPHIC EMULSION COMPRISING METHINE COMPOUND AND SILVER HALIDE PHOTOGRAPHIC MATERIAL

FIELD OF THE INVENTION

The present invention relates to a novel methine compound, a silver halide photographic emulsion containing the same which is high sensitive and excellent in storage stability, and a silver halide photographic material comprising the same emulsion.

BACKGROUND OF THE INVENTION

Every endeavor has been done for higher sensitization and improvement of storage stability of a silver halide photographic material. It is known that the performances of a silver halide photographic material are greatly affected by sensitizing dyes which are used for spectral sensitization. Accordingly, many researchers have hitherto synthesized various kinds of sensitizing dyes and endeavored to investigate photographic performances. However, it is not possible to know the effects in advance.

Various trials of reduction sensitization for higher sensitization of a silver halide photographic material has been discussed for long. As useful compounds as the reduction sensitizers, e.g., tin compounds are disclosed in U.S. Pat. No. 2,487,850, polyamine compounds in U.S. Pat. No. 2,512,925, and thiourea dioxide series compounds in British Patent 789,823. Further, the characteristics of silver specks produced by various reduction sensitizing methods are compared in *Photographic Science and Engineering*, Vol. 23, p. 113 (1979), and dimethylamineborane, stannous chloride, hydrazine, and the methods of high pH ripening and low pAg ripening have been adopted. Reduction sensitizing methods are further disclosed in U.S. Pat. Nos. 2,518,698, 3,201,254, 3,411,917, 3,779,777 and 3,930,867. Not only the selection of reduction sensitizers but the contrivances of reduction sensitizing methods are disclosed in JP-B-57-33572 and JP-B-58-1410 (the term "JP-B" as used herein means an "examined Japanese patent publication").

However, according to the studies by the present inventors, it has been confirmed that when spectral sensitization is performed by adsorbing sensitizing dyes onto reduction sensitized silver halide grains, it is extremely difficult to obtain sufficient spectral sensitization without causing undesired effects on photographic performance (e.g., the increase of fog during storage).

For that reason, a technique of spectrally sensitizing reduction-sensitized silver halide grains in high sensitivity without causing adverse effects such as fog during storage has been required.

SUMMARY OF THE INVENTION

An object of the present invention is to provide a silver halide photographic emulsion which is high speed and excellent in storage stability, and a silver halide photographic material containing the same.

The above object of the present invention has been attained by the following means.

(1) A silver halide photographic emulsion which comprises at least one methine compound represented by the following formula (I):

(I)

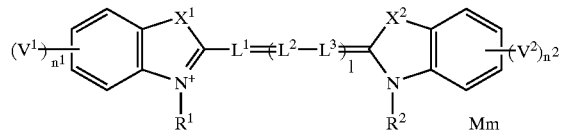

wherein $X^1$ and $X_2$ each represents an oxygen atom, a sulfur atom, a selenium atom, or N—$R^3$, wherein $R^3$ represents a hydrogen atom, a substituted or unsubstituted alkyl group, a substituted or unsubstituted aryl group, or a heterocyclic group; $V^1$ and $V^2$ each represents a monovalent substituent; $n^1$ and $n^2$ each represents 0, 1, 2, 3 or 4; $L^1$, $L^2$ and $L^3$ each represents a methine group; l represents an integer of 0 to 3; M represents a counter ion for balancing electric charge; m represents a number necessary for balancing electric charge; and $R^1$ and $R^2$ each represents a substituted or unsubstituted alkyl group, a substituted or unsubstituted aryl group or a substituted or unsubstituted heterocyclic group, but at least either $R^1$ or $R^2$ represents the alkyl group represented by any of the following formulae:

$$R_a=(Qa)_r\mathrm{CO}\overline{\mathrm{N}}\mathrm{SO}_2\mathrm{R}aa$$

$$R_b=(Qb)_s\mathrm{SO}_2\overline{\mathrm{N}}\mathrm{COR}bb$$

$$R_c=(Qc)_t\mathrm{CO}\overline{\mathrm{N}}\mathrm{COR}cc$$

$$R_d=(Qd)_u\mathrm{SO}_2\overline{\mathrm{N}}\mathrm{SO}_2\mathrm{R}dd$$

$$R_e=(Qe)_v\mathrm{X}$$

wherein Raa, Rbb, Rcc and Rdd each represents an alkyl group, an aryl group, a heterocyclic group, an alkoxyl group, an aryloxy group, a heterocyclyloxy group, or an amino group; Qa, Qb, Qc, Qd and Qe each represents a divalent linking group; X represents $SO_3^-$, $CO_2^-$, or $PO_3^{2-}$; and r, s, t, u and v each represents an integer of 1 or more, but when X represents $SO_3^-$, V represents 1 or 2.

(2) The silver halide photographic emulsion comprising a methine compound as described in the above item (1), wherein 1 in formula (I) represents 0.

(3) The silver halide photographic emulsion comprising a methine compound as described in the above item (1) or (2), wherein either $X^1$ or $X^2$ represents an oxygen atom and the other represents a sulfur atom.

(4) The silver halide photographic emulsion comprising a methine compound as described in the above item (1), (2) or (3), wherein at least either $R^1$ or $R^2$ represents a sulfoethyl group and the other represents a group having a dissociable group.

(7) The silver halide photographic emulsion comprising a methine compound as described in the above item (1), (2), (3), (4), (5) or (6), wherein either $V^1$ or $V^2$ represents an aromatic group and the other represents a chlorine atom, and each is substituted on the 5-position.

(8) The silver halide photographic emulsion comprising a methine compound as described in the above item (1), wherein the methine compound is represented by the following formula:

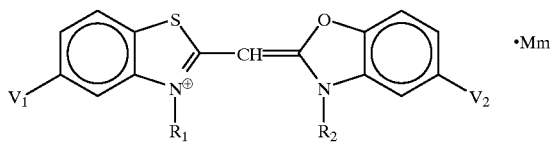

wherein when $V_1$ is Cl, $V_2$ is a phenyl group, or when V, is a phenyl group, $V_2$ is Cl; when $R_1$ is $(CH_2)_2SO_3$—, $R_2$ is $(CH_2)_3SO_3$—, or when $R_1$ is $(CH_2)3SO_3$—, $R_2$ is $(CH_2)_2SO_3$—; M represents a counter ion for balancing electric charge; and m represents a number necessary for balancing electric charge.

(9) The silver halide photographic emulsion comprising a methine compound as described in the above item (1), (2), (3), (4), (5), (6) or (7), wherein the silver halide photographic emulsion comprises at least one sensitizing dye having different structure from the methine compound represented by formula (I) and having spectral absorption maximum wavelength of from 400 nm to 500 nm.

(10) The silver halide photographic emulsion comprising a methine compound as described in the above item (1), (2), (3), (4), (5), (6), (7) or (8), wherein the silver halide grains of the silver halide photographic emulsion have been reduction-sensitized.

(11) A silver halide photographic material which comprises the silver halide photographic emulsion as described in the above item (1), (2), (3), (4), (5), (6), (7), (8) or (9).

DETAILED DESCRIPTION OF THE INVENTION

Formula (I) is described in further detail below.

$X^1$ and $X_2$ each represents an oxygen atom, a sulfur atom, a selenium atom, or N—$R^3$, wherein $R^3$ represents a hydrogen atom, a substituted or unsubstituted alkyl group, a substituted or unsubstituted aryl group, or a heterocyclic group, preferably represents an oxygen atom or a sulfur atom, and particularly preferably either $X^1$ or $X_2$ represents an oxygen atom and the other represents a sulfur atom, and most preferably $X^1$ represents a sulfur atom and $X_2$ represents an oxygen atom.

$V^1$ and $V^2$ each represents a monovalent substituent. The monovalent substituents are not particularly restricted (the substituents of $V^1$ and $V^2$ are hereinafter called V collectively). Examples of V include, e.g., a halogen atom (e.g., chlorine, bromine, iodine, fluorine), a mercapto group, a cyano group, a carboxyl group, a phosphoric acid group, a sulfo group, a hydroxyl group, a carbamoyl group having from 1 to 10, preferably from 2 to 8, and more preferably from 2 to 5, carbon atoms (e.g., methylcarbamoyl, ethylcarbamoyl, morpholino), a sulfamoyl group having from 0 to 10, preferably from 2 to 8, and more preferably from 2 to 5, carbon atoms (e.g., methylsulfamoyl, ethylsulfamoyl, piperidinosulfonyl), a nitro group, an alkoxyl group having from 1 to 20, preferably from 1 to 10, and more preferably from 1 to 8, carbon atoms (e.g., methoxy, ethoxy, 2-methoxyethoxy, 2-phenylethoxy), an aryloxy group having from 6 to 20, preferably from 6 to 12, and more preferably from 6 to 10, carbon atoms (e.g., phenoxy, p-methylphenoxy, p-chlorophenoxy, naphthoxy), an acyl group having from 1 to 20, preferably from 2 to 12, and more preferably from 2 to 8, carbon atoms (e.g., acetyl, benzoyl, trichloroacetyl), an acyloxy group having from 1 to 20, preferably from 2 to 12, and more preferably from 2 to 8, carbon atoms (e.g., acetyloxy, benzoyloxy), an acylamino group having from 1 to 20, preferably from 2 to 12, and more preferably from 2 to 8, carbon atoms (e.g., acetylamino), a sulfonyl group having from 1 to 20, preferably from 1 to 10, and more preferably from 1 to 8, carbon atoms (e.g., methanesulfonyl, ethanesulfonyl, benzenesulfonyl), a sulfinyl group having from 1 to 20, preferably from 1 to 10, and more preferably from 1 to 8, carbon atoms (e.g., methanesulfinyl, benzenesulfinyl), a sulfonylamino group having from 1 to 20, preferably from 1 to 10, and more preferably from 1 to 8, carbon atoms (e.g., methanesulfonylamino, ethanesulfonylamino, benzenesulfonylamino), an amino group, a substituted amino group having from 1 to 20, preferably from 1 to 12, and more preferably from 1 to 8, carbon atoms (e.g., methylamino, dimethylamino, benzylamino, anilino, diphenylamino), an ammonium group having from 0 to 15, preferably from 3 to 10, and more preferably from 3 to 6, carbon atoms (e.g., trimethylammonium, triethylammonium), a hydrazino group having from 0 to 15, preferably from 1 to 10, and more preferably from 1 to 6, carbon atoms (e.g., trimethylhydrazino), a ureido group having from 1 to 15, preferably from 1 to 10, and more preferably from 1 to 6, carbon atoms (e.g., ureido, N,N-dimethylureido), an imido group having from 1 to 15, preferably from 1 to 10, and more preferably from 1 to 6, carbon atoms (e.g., succinimido), an alkyl- or arylthio group having from 1 to 20, preferably from 1 to 12, and more preferably from 1 to 8, carbon atoms (e.g., methylthio, ethylthio, carboxyethylthio, sulfobutylthio, phenylthio), an alkoxycarbonyl group having from 2 to 20, preferably from 2 to 12, and more preferably from 2 to 8, carbon atoms (e.g., methoxycarbonyl, ethoxycarbonyl, benzyloxycarbonyl), an aryloxycarbonyl group having from 6 to 20, preferably from 6 to 12, and more preferably from 6 to 8, carbon atoms (e.g., phenoxycarbonyl), an unsubstituted alkyl group having from 1 to 18, preferably from 1 to 10, and more preferably from 1 to 5, carbon atoms (e.g., methyl, ethyl, propyl, butyl), a substituted alkyl group having from 1 to 18, preferably from 1 to 10, and more preferably from 1 to 5, carbon atoms (e.g., hydroxymethyl, trifluoromethyl, benzyl, carboxyethyl, ethoxycarbonylmethyl, acetylaminomethyl; an unsaturated hydrocarbon group preferably having from 2 to 18, more preferably from 3 to 10, and particularly preferably from 3 to 5, carbon atoms (e.g., vinyl, ethynyl, 1-cyclohexenyl, benzylidyne, benzylidene) are also included in a substituted alkyl group), a substituted or unsubstituted aryl group having from 6 to 20, preferably from 6 to 15, and more preferably from 6 to 10, carbon atoms (e.g., phenyl, naphthyl, p-carboxyphenyl, p-nitrophenyl, 3,5-dichlorophenyl, p-cyanophenyl, m-fluorophenyl, p-tolyl), and a substituted or unsubstituted heterocyclic group having from 1 to 20, preferably from 2 to 10, and more preferably from 4 to 6, carbon atoms (e.g., pyridyl, 5-methylpyridyl, thienyl, furyl, morpholino, tetrahydrofurfuryl). $V^1$ and $V^2$ may take a condensed ring structure (a hydrocarbon ring or a heterocyclic ring).

These substituents may further be substituted with V.

$V^1$ and $V^2$ each preferably represents an alkyl group, an aryl group, a heterocyclic group, an alkoxyl group, a halogen atom, an acyl group, a cyano group, or an alkoxy-carbonyl group, more preferably an alkyl group, an aryl group, an alkoxyl group, a halogen atom, or a cyano group, and particularly preferably a methyl group, a phenyl group, a methoxy group, a fluorine atom, a chlorine atom, a bromine atom, an iodine atom, or a cyano group, and most preferably a phenyl group or a chlorine atom.

A preferred combination of $V^1$ and $V^2$ is the case where at least either $V^1$ or $V^2$ represents an aromatic group or at least either $V^1$ or $V^2$ represents a chlorine atom. Particularly preferred is the case where either represents an aromatic group and other represents a chlorine atom, and more preferred is that $V^1$ represents a chlorine atom and $V^2$ represents a phenyl group.

$n^1$ and $n^2$ each represents 0, 1, 2, 3 or 4. $n^1$ and $n^2$ each preferably represents 1 or 2, and more preferably $n^1$ and $n^2$ both represent 1.

When $n^1$ and $n^2$ each represents 2 or more, $V^1$ and $V^2$ are repeated but they may be the same or different.

When $n^1$ and $n^2$ each represents 1, $V^1$ and $V^2$ are preferably substituted on the 5-position. When $n^1$ and $n^2$ each represents 2, and $V^1$ and $V^2$ are bonded to each other to form a ring, $V^1$ and $V^2$ are preferably substituted on the 4-position and the 5-position, or the 5-position and the 6-position, more preferably 4-position and the 5-position. The numbers of the positions are as follows.

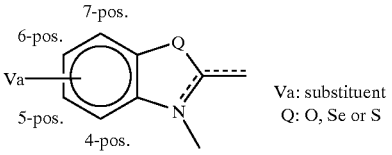

A particularly preferred combination of $V^1$ and $V^2$ and a substitution position are the case where $V^1$ represents a chlorine atom and substituted on the 5-position and $V^2$ represents a phenyl group and substituted on the 5-position.

$L^1$, $L^2$ and $L^3$ each represents a methine group. $L^1$, $L^2$ and $L^3$ each may be substituted. Examples of the substituents include the above-described V. For example, a methyl group, a phenyl group, a halogen atom (e.g., chlorine, bromine, fluorine, iodine) a methoxy group, a methylthio group, a phenylthio group, and an amino group can be exemplified. $L^1$, $L^2$ and $L^3$ may form a ring together with other L, $V^1$ $V^2$ $R^1$ and $R^2$. $L^1$, $L^2$ and $L^3$ each represents an unsubstituted methine group or a methine group substituted with a methyl group or an ethyl group.

l represents an integer of from 0 to 3, preferably 0 or 1, and particularly preferably 0.

When l represents 2 or more, $L^1$, $L^2$ and $L^3$ are repeated but they may be the same or different.

The most preferred combination of $L^1$, $L^2$, $L^3$ and l is the case where l represents 0, and $L^1$ represents an unsubstituted methine group, i.e., the case where a methine chain-unsubstituted monomethine compound is formed as a whole.

$R^1$ and $R^2$ each represents a substituted or unsubstituted alkyl group, a substituted or unsubstituted aryl group or a substituted or unsubstituted heterocyclic group, for example, an unsubstituted alkyl group having from 1 to 18, preferably from 1 to 7, and particularly preferably from 1 to 4, carbon atoms (e.g., methyl, ethyl, propyl, isopropyl, butyl, isobutyl, hexyl, octyl, dodecyl, octadecyl), a substituted alkyl having from 1 to 18, preferably from 1 to 7, and particularly preferably from 1 to 4, carbon atoms {e.g., an alkyl group substituted with V, preferably an aralkyl group (e.g., benzyl, 2-phenylethyl)), an unsaturated hydrocarbon group (e.g., allyl), a hydroxyalkyl group (e.g., 2-hydroxyethyl, 3-hydroxypropyl), a carboxyalkyl group (e.g., 2-carboxyethyl, 3-carboxypropyl, 4-carboxybutyl, carboxymethyl), an alkoxyalkyl group (e.g., 2-methoxyethyl, 2-(2-methoxyethoxy)ethyl), an aryloxyalkyl group (e.g., 2-phenoxyethyl, 2-(1-naphthoxy)ethyl), an alkoxycarbonylalkyl group (e.g., ethoxycarbonylmethyl, 2-benzyloxycarbonylethyl), an aryloxycarbonylalkyl group (e.g., 3-phenoxycarbonylpropyl), an acyloxyalkyl group (e.g., 2-acetyloxyethyl), an acylalkyl group (e.g., 2-acetylethyl), a carbamoylalkyl group (e.g., 2-morpholinocarbonylethyl), a sulfamoylalkyl group (e.g., N,N-dimethylsulfamoylmethyl), a sulfoalkyl group (e.g., 2-sulfo-ethyl, 3-sulfopropyl, 3-sulfobutyl, 4-sulfobutyl, 2-(3-sulfo-propoxy)ethyl, 2-hydroxy-3-sulfopropyl, 3-sulfopropoxyethoxyethyl), a sulfoalkenyl group, a sulfatoalkyl group (e.g., 2-sulfatoethyl, 3-sulfatopropyl, 4-sulfatobutyl), a heterocyclic alkyl group (e.g., 2-(pyrrolidin-2-one-1-yl)ethyl, tetrahydrofurfuryl), an alkylsulfonylcarbamoylalkyl group (e.g., methanesulfonylcarbamoylmethyl), an acylcarbamoylalkyl group (e.g., acetylcarbamoylmethyl), an acylsulfamoylalkyl group (e.g., acetylsulfamoylmethyl), an alkylsulfonylsulfamoylalkyl group (e.g., methanesulfonylsulfamoylmethyl)}, an unsubstituted aryl group having from 6 to 20, preferably from 6 to 10, and more preferably from 6 to 8, carbon atoms (e.g., phenyl, 1-naphthyl), a substituted aryl group having from 6 to 20, preferably from 6 to 10, and more preferably from 6 to 8, carbon atoms (e.g., an aryl group substituted with V, specifically, p-methoxyphenyl, p-methylphenyl, p-chlorophenyl), an unsubstituted heterocyclic group having from 1 to 20, preferably from 3 to 10, and more preferably from 4 to 8, carbon atoms (e.g., 2-furyl, 2-thienyl, 2-pyridyl, 3-pyrazolyl, 3-isooxazolyl, 3-isothiazolyl, 2-imidazolyl, 2-oxazolyl, 2-thiazolyl, 2-pyridazolyl, 2-pyrimidyl, 3-pyrazyl, 2-(1,3,5-triazolyl), 3-(1,2,4-triazolyl), 5-tetrazolyl), and a substituted heterocyclic group having from 1 to 20, preferably from 3 to 10, and more preferably from 4 to 8, carbon atoms (e.g., a heterocyclic group substituted with V, specifically, 5-methyl-2-thienyl, 4-methoxy-2-pyridyl) can be exemplified.

However, at least either $R^1$ or $R^2$ represents an alkyl group represented by Ra, Rb, Rc, Rd or Re.

Raa, Rbb, Rcc and Rdd each represents an alkyl group, an aryl group, a heterocyclic group, an alkoxyl group, an aryloxy group, a heterocyclyloxy group, or an amino group.

Specific examples of these groups include an unsubstituted alkyl group having from 1 to 18, preferably from 1 to 10, and more preferably from 1 to 5, carbon atoms (e.g., methyl, ethyl, propyl, butyl), a substituted alkyl group having from 1 to 18, preferably from 1 to 10, and more preferably from 1 to 5, carbon atoms (e.g., hydroxymethyl, trifluoromethyl, benzyl, carboxyethyl, ethoxycarbonylmethyl, acetylaminomethyl; an unsaturated hydrocarbon group preferably having from 2 to 18, more preferably from 3 to 10, and particularly preferably from 3 to 5, carbon atoms (e.g., vinyl, ethynyl, 1-cyclohexenyl, benzylidyne, benzylidene) are also included in a substituted alkyl group), a substituted or unsubstituted aryl group having from 6 to 20, preferably from 6 to 15, and more preferably from 6 to 10, carbon atoms (e.g., phenyl, naphthyl, p-carboxyphenyl, p-nitrophenyl, 3,5-dichlorophenyl, p-cyanophenyl, m-fluorophenyl, p-tolyl), a substituted heterocyclic group having from 1 to 20, preferably from 2 to 10, and more preferably from 4 to 6, carbon atoms (e.g., pyridyl, 5-methylpyridyl, thienyl, furyl, morpholino, tetrahydrofurfuryl), an alkoxy group having from 1 to 10, preferably from 1 to 8, carbon atoms (e.g., methoxy, ethoxy, 2-methoxyethoxy, 2-hydroxyethoxy, 2-phenylethoxy), an aryloxy group having from 6 to 20, preferably from 6 to 12, and more preferably from 6 to 10, carbon atoms (e.g., phenoxy, p-methylphenoxy, p-chlorophenoxy, naphthoxy), a heterocyclyloxy group having from 1 to 20, preferably from 3 to 12, and more preferably from 3 to 10, carbon atoms (i.e., an oxy group substituted with a heterocyclic group, e.g., 2-thienyloxy, 2-morpholinooxy), and an amino group having from 0 to 20, preferably from 0 to 12, and more preferably from 0 to 8, carbon atoms (e.g., amino, methylamino, dimethylamino, ethylamino, diethylamino, hydroxyethylamino, benzylamino, anilino, diphenylamino, morpholino which forms a ring, pyrrolidino). These groups may further be substituted with V.

Raa, Rbb, Rcc and Rdd each preferably represents a methyl group, an ethyl group, or a hydroxyethyl group, and more preferably represents a methyl group.

Qa, Qb, Qc, Qd and Qe each represents a divalent linking group. Examples of the divalent linking groups include divalent linking groups having from 1 to 20 carbon atoms composed of combinations of one or more of an alkylene group (e.g., methylene, ethylene, propylene, butylene, pentylene), an arylene group (e.g., phenylene, naphthylene), an alkenylene group (e.g., ethenylene, propenylene), an alkynylene group (e.g., ethynylene, propinylene), an amido group, an ester group, a sulfonamido group, a sulfonate group, a ureido group, a sulfonyl group, a sulfinyl group, a thioether group, an ether group, a carbonyl group, —N(Rq)— (wherein Rq represents a hydrogen atom, a substituted or unsubstituted alkyl group, a substituted or unsubstituted aryl group), a heterocyclic divalent group (e.g., 6-chloro-1,3,5-triazine-2,4-diyl, pyrimidine-2,4-diyl, quinoxaline-2,3-diyl).

Preferred examples of divalent linking groups include divalent linking groups having from 1 to 20 carbon atoms composed of a combination of one or more of an alkylene group having from 1 to 4 carbon atoms (e.g., methylene, ethylene, propylene, butylene), an arylene group having from 6 to 10 carbon atoms (e.g., phenylene, naphthylene), an alkenylene group having from 1 to 4 carbon atoms (e.g., ethenylene, propenylene), and an alkynylene group having from 1 to 4 carbon atoms (e.g., ethynylene, propinylene).

These divalent linking groups may be arbitrarily substituted, and the above-described V are preferred as the substituents. Specific examples of the divalent linking groups having a substituent include a methyl-substituted methylene group, an ethyl-substituted methylene group, a phenyl-substituted methylene group, a hydroxy-substituted methylene group, and a halogen atom (e.g., chlorine, bromine)-substituted methylene group.

Qa, Qb, Qc, Qd and Qe each preferably represents an unsubstituted methylene group.

X represents $SO_3^-$, $CO_2^-$, or $PO_3^{2-}$, preferably $SO_3^-$or $CO_2^-$, and particularly preferably $SO_3^-$.

r, s, t, u and v each represents an integer of 1 or more, but when X represents $SO_3^-$, v represents 1 or 2. r, s, t and u each preferably represents 1, and v preferably represents 2.

When r, s, t, u and v each preferably represents 2 or more, Qa, Qb, Qc, Qd and Qe are repeated but they may be the same or different.

Preferred examples either $R^1$ or $R^2$ represents are shown below.

$R_{101}=CH_2CO\overline{N}SO_2CH_3$ $R_{102}=CH_2SO_2\overline{N}COCH_3$ $R_{103}=CH_2CO\overline{N}COCH_3$ $R_{104}=CH_2SO_2\overline{N}SO_2CH_3$ $R_{105}=(CH_2)_2CO\overline{N}SO_2CH_3$ $R_{106}=CH_2CO\overline{N}SO_2C_2H_5$ $R_{107}=(CH_2)_3CO\overline{N}SO_2CH_3$ $R_{108}=(CH_2)_3SO_2\overline{N}COCH_3$ $R_{109}=(CH_2)_3CO\overline{N}COCH_3$ $R_{110}=(CH_2)_3SO_2\overline{N}SO_2CH_3$ $R_{111}=(CH_2)_2SO_3^-$ $R_{112}=CH_2SO_3^-$ $R_{113}=CH_2CO_2^-$ $R_{114}=(CH_2)_2CO_2^-$ $R_{115}=(CH_2)_2PO_3^{2-}$ $R_{116}=CH_2PO_3^{2-}$ Of $R_{101}$ to $R_{110}$, younger numbers are preferred, and $R_{101}$ is most preferred.

Dissociable groups are all described in the form of dissociation ($N^-$) but it is possible to be non-dissociable form (NH). In practice, a dye comes to dissociable state or non-dissociable state in accordance with the environment of a dye such as pH.

As the notation, when a cationic compound is present as the counter salt, a dissociable group is described as ($N^-$, $Na^+$) and when a dissociable group is in non-dissociable state, it is described as (NH). However, it can be described as ($N^-$, $H^+$) considering the cationic compound as the counter salt being proton.

Of $R_{111}$ to $R_{116}$, younger numbers are preferred, and $R_{111}$ is most preferred.

Of $R_{101}$ to $R_{116}$, $R_{111}$ is most preferred.

It is preferred that at least one of $R^1$ and $R^2$ represents a sulfoethyl group ($R_{111}$) and the other represents a group having a dissociable group.

The dissociable group used herein means a group capable of coming to dissociable state in accordance with the environment of a dye such as pH, e.g., a proton dissociable acidic group 90% or more of which is dissociated between pH 5 and 8 can be exemplified. Specific examples of such groups include a sulfo group, a carboxyl group, a sulfato group, a phosphoric acid group, a boric acid group, an alkylsulfonylcarbamoyl group, an acylcarbamoyl group, an acylsulfamoyl group, and an alkylsulfonylsulfamoyl group can be exemplified. Among these, a sulfo group and a carboxyl group are preferred and a sulfo group is most preferred.

A group having a dissociable group is a substituent having the above-described dissociable group, such as an alkyl group, an aromatic group and a heterocyclic group having the above-described dissociable group, specifically, e.g., a sulfoalkyl group, a carboxyalkyl group, a sulfatoalkyl group, a phosphoric acid alkyl group, an alkylsulfonylcarbamoylalkyl group, an acylcarbamoylalkyl group, an acylsulfamoylalkyl group, and an alkylsulfonylsulfamoylalkyl group can be exemplified. Preferred of these is a sulfoalkyl group, particularly preferred is a sulfoethyl group (e.g., 2-sulfoethyl), a sulfopropyl group (e.g., 3-sulfopropyl), orasulfobutyl group (e.g., 4-sulfobutyl, 3-sulfobutyl) and most preferred is a sulfopropyl group.

Particularly preferred as $R^1$ and $R^2$ is the case where either $R^1$ or $R^2$ represents a sulfoethyl group and the other represents a sulfopropyl group, and most preferred is that $R^1$ represents a sulfopropyl group and $R^2$ represents a sulfoethyl group.

M is contained in the formula to show the presence of a cation or an anion necessary to neutralize electric charge.

Representative examples of cations include an inorganic cation such as a hydrogen ion ($H^+$), an alkali metal ion (e.g., a sodium ion, a potassium ion, a lithium ion), and an alkaline earth metal ion (e.g., a calcium ion), and an organic cation such as an ammonium ion (e.g., an ammonium ion, a tetraalkylammonium ion, a pyridiniumion, an ethylpyridiniumion). Anions maybe inorganic or organic, and examples thereof include a halogen anion (e.g., a fluorine ion, a chlorine ion, an iodine ion), a substituted arylsulfonate ion (e.g., p-toluenesulfonate ion, a p-chlorobenzenesulfonate ion), an aryldisulfonate ion (e.g., a 1,3-bezenesulfonate ion, a 1,5-naphthalenedisulfonate ion, a 2,6-naphthalenedisulfonate ion), an alkylsulfate ion (e.g., a methylsulfate ion), a sulfate ion, a thiocyanate ion, a perchloric acid ion, a tetrafluoroborate ion, a picrate ion, an acetate ion, and a trifluoromethanesulfonate ion. Further, an ionic polymer or other dye having counter electric charge to a dye may be used as M. Also, when $CO_2^-$, $SO_3^-$and $PO_3^-$have a hydrogen ion as a counter ion, they each may be described as $CO_2H$, $SO_3H$ and $PO_3H_2$, respectively.

m represents a necessary number for balancing electric charge, preferably from 0 to 4, more preferably from 0 to 1. When an inner salt is formed, m represents 0.

The sensitizing dye having different structure from the methine compound represented by formula (I) and having spectral absorption maximum wavelength of from 400 nm to 500 nm may be any dyes.

Examples of such dyes include a cyanine dye, a styryl dye, a hemicyanine dye, a merocyanine dye, a trinuclear merocyanine dye, a tetranuclear merocyanine dye, a rhodacyanine dye, a complex cyanine dye, a complex merocyanine dye, an allopolar dye, an oxonol dye, a hemioxonol dye, a squarylium dye, a croconium dye, an azamethine dye, a coumarin dye, an arylidene dye, an anthraquinone dye, a triphenylmethane dye, an azo dye, an azomethine dye, a spiro compound, a metallocene dye, a fluorenone dye, a fulgide dye, a perylene dye, a phenazine dye, a phenothiazine dye, a quinone dye, an indigo dye, a diphenylmethane dye, a polyene dye, an acridine dye, an acridinone dye, a diphenylamine dye, a quinacridone dye, a quinophthalone dye, a phthaloperylene dye, a porphyrin dye, a chlorophyll dye, a phthalocyanine dye, and a metal complex dye.

Preferred of these are polymethine chromophores such as a cyanine dye, a styryl dye, a hemicyanine dye, a merocyanine dye, a trinuclear merocyanine dye, a tetranuclear merocyanine dye, a rhodacyanine dye, a complex cyanine dye, a complex merocyanine dye, an allopolar dye, an oxonol dye, a hemioxonol dye, a squarylium dye, a croconium dye, and an azamethine dye, more preferred are a cyanine dye, a merocyanine dye, a trinuclear merocyanine dye, a tetranuclear merocyanine dye, and a rhodacyanine dye, particularly preferred are a cyanine dye, a merocyanine dye, and a rhodacyanine dye, and most preferred is a cyanine dye.

These dyes are described in detail in F. M. Harmer, *Heterocyclic Compounds—Cyanine Dyes and Related Compounds*, John Wiley & Sons, New York, London (1964), D. M. Sturmer, *Heterocyclic Compounds—Special Topics in Heterocyclic Chemistry*, Chap. 18, Clause 14, pp. 482 to 515. Formulae (XI), (XII) and (XIII) disclosed in U.S. Pat. No. 5,340,694, columns 21 and 22 are preferred as general formulae of the cyanine, merocyanine and rhodacyanine dyes, respectively. However, the numbers of n12, n15, n17 and n18 are not limited, and they may be an integer of 0 or more (preferably 0).

The sensitizing dye having different structure from the methine compound represented by formula (I) and having spectral absorption maximum wavelength of from 400 nm to 500 nm is preferably represented by the following formula (II):

(II)

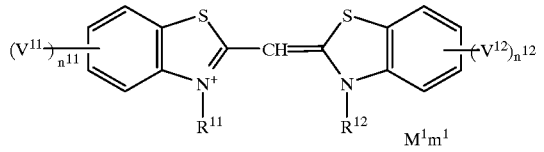

wherein $V^{11}$ and $V^{12}$ each represents a monovalent substituent, e.g., the monovalent substituents represented by $V^1$ and $V^2$ described above can be exemplified, preferably a halogen atom and particularly preferably a chlorine atom.

$n^{11}$ and n12 each represents 0, 1, 2, 3 or 4, preferably 1.

$R^{11}$ and $R^{12}$ each represents a substituted or unsubstituted alkyl group, a substituted or unsubstituted aryl group or a substituted or unsubstituted heterocyclic group, e.g., the substituents represented by $R^1$ and $R^2$ described above can be exemplified, preferably a sulfoalkyl group and particularly preferably a sulfopropyl group or a sulfobutyl group.

$M^1$ represents a counter ion for balancing electric charge. $m^1$ represents a number necessary for balancing electric charge.

The spectral absorption maximum wavelength of the sensitizing dye having different structure from the methine compound represented by formula (I) is preferably from 430 to 490 nm, more preferably from 450 to 490 nm, still more preferably from 460 to 485 nm, particularly preferably from 465 to 475 nm, and most preferably from 468 to 474 nm.

Specific examples of the methine compounds represented by formula (I) or (II) according to the present invention are shown below, but the present invention is not limited thereto.

Specific Examples of the Methine Compounds Represented by Formula (I)

(1)

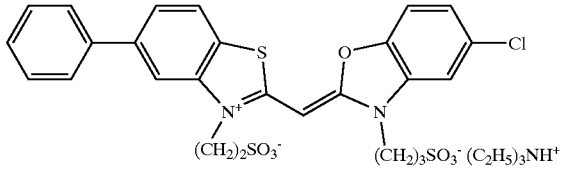

(2)

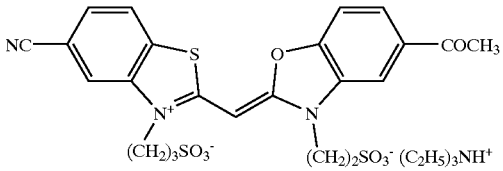

(3)

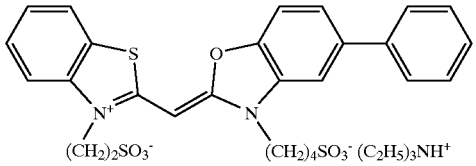

-continued
(4)
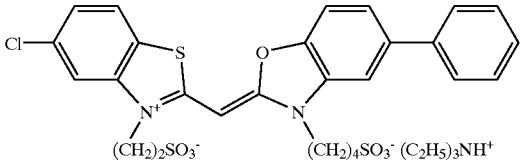
(5)
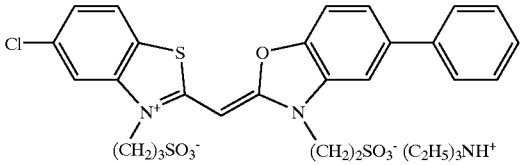
(6)
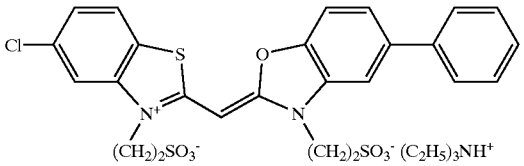
(7)
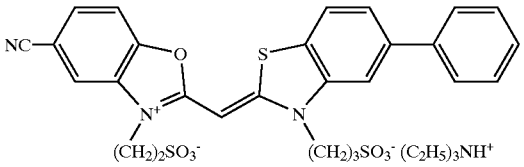
(8)
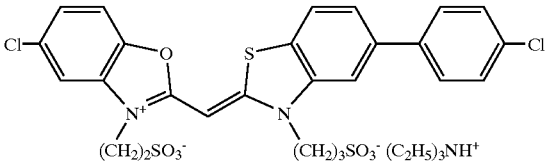
(9)
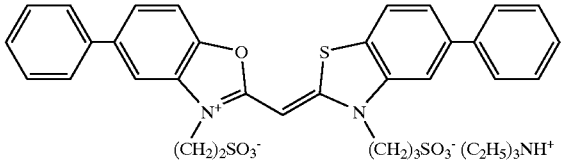
(10)
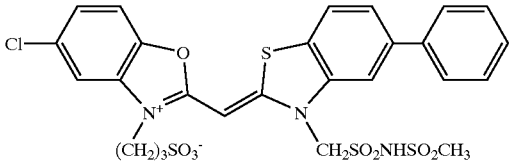
(11)
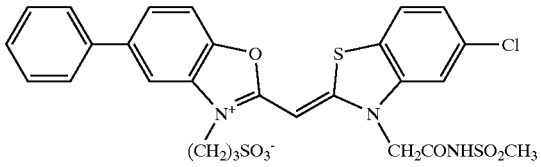
-continued
(12)
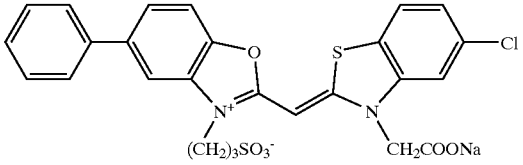
Specific Examples of the Methine Compounds Represented by Formula (II)
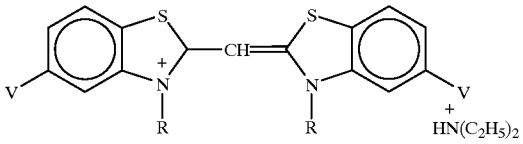
| No. | R | V |
|---|---|---|
| (101) | $(CH_2)_3SO_3$— | Cl |
| (102) | $(CH_2)_2CH(CH_3)SO_3$— | " |
| (103) | $(CH_2)_2CH(C_2H_5)SO_3$— | " |
| (104) | $(CH_2)_2CH(C_6H_5)SO_3$— | " |
| (105) | $(CH_2)_2CH(CH_3)CO_2$— | " |
| (106) | $(CH_2)_2SO_3$— | " |
| (107) | $(CH_2)_4SO_3$— | " |
| (108) | $CH_2CH{=}CHSO_3$— | " |
| (109) | $(CH_2)_3SO_3$— | Br |
| (110) | " | I |
| (111) | " | $CN^-$ |
| (112) | " | $COCH_3$ |
| (113) | " | $CO_2CH_3$ |
| (114) | " | 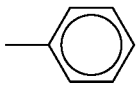 |
| (115) | " | 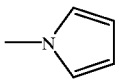 |
| (116) | " | 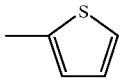 |
| (117) | " | 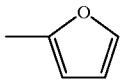 |

The compounds represented by formula (I) or (II) can be synthesized according to the methods described in F. M. Harmer, *Heterocyclic Compounds—Cyanine Dyes and Related Compounds*, John Wiley & Sons, New York, London (1964), D. M. Sturmer, *Heterocyclic Compounds—Special Topics in Heterocyclic Chemistry*, Chap. 18, Clause 14, pp. 482 to 515, John Wiley & Sons, New York, London (1977), and *Rodd's Chemistry of Carbon Compounds,* 2nd Ed., Vol. IV, Part B, Chap. 15, pp. 369 to 422, Elsevier Science Publishing Company Inc., New York (1977), etc.

The sensitizing dyes other than the sensitizing dyes according to the present invention may be used in the present invention or the sensitizing dyes according to the present invention may be used in combination with other sensitizing dyes. The dyes which can be used include a cyanine dye, a merocyanine dye, a complex cyanine dye, a complex merocyanine dye, a holopolar cyanine dye, a hemicyanine dye, a styryl dye, and a hemioxonol dye. Particularly useful dyes are dyes belonging to a cyanine dye, a merocyanine dye and a complex merocyanine dye. Nuclei which are usually utilized as basic heterocyclic nuclei in cyanine dyes can be applied to these dyes. For example, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus; the above nuclei to which alicyclic hydrocarbon rings are fused; the above nuclei to which aromatic hydrocarbon rings are fused, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, and a quinoline nucleus can be exemplified. These heterocyclic nuclei may be substituted on the carbon atoms.

As a nucleus having a ketomethylene structure, a 5- or 6-membered heterocyclic nucleus such as a pyrazolin-5-one nucleus, a thiohydantoin nucleus, a 2-thiooxazoline-2,4-dione nucleus, a thiazoline-2,4-dione nucleus, a rhodanine nucleus, or a thiobarbituric acid nucleus can be applied to a merocyanine dye or a complex merocyanine dye.

These sensitizing dyes maybe used alone or in combination. A combination of sensitizing dyes is often used for the purpose of supersensitization. Examples thereof are disclosed in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, 4,026,707, British Patents 1,344,281, 1,507,803, JP-B-43-4936, JP-B-53-12375, JP-A-52-110618 (the term "JP-A-" as used herein means an "unexamined Japanese Patent application") and JP-A-52-109925.

Further, dyes which themselves do not have a spectral sensitizing function or substances which substantially do not absorb visible light but show supersensitization can be incorporated into an emulsion with sensitizing dyes.

Sensitizing dyes may be added to an emulsion at any stage of the preparation of an emulsion hitherto known to be useful. In general, it is performed during the period after the completion of chemical sensitization and before coating, however, a method in which sensitizing dyes are added at the same time with the addition of chemical sensitizers and spectral sensitization is carried out simultaneously with chemical sensitization can be employable as disclosed in U.S. Pat. Nos. 3,628,969 and 4,225,666, further, as disclosed in JP-A-58-113928, spectral sensitization can be performed prior to chemical sensitization, or sensitizing dyes can be added and spectral sensitization can be started before completion of the precipitation formation of the silver halide grains. Still further, as disclosed in U.S. Pat. No. 4,225,666, sensitizing dyes can be divided and added separately, i.e., a part of them is added prior to chemical sensitization and the remaining is added after chemical sensitization, therefore, any time during silver halide grain formation is feasible, as well as the methods disclosed in U.S. Pat. No. 4,183,756.

A sensitizing dye can be added preferably in an amount of from $4\times10^{-6}$ to $8\times10^{-3}$ mol per mol of the silver halide.

The sensitizing dyes according to the present invention can be directly dispersed in an emulsion. They may be dissolved in an appropriate solvent, e.g., methyl alcohol, ethyl alcohol, methyl cellosolve, acetone, water, pyridine, or mixtures of these solvents, and may be added to an emulsion as a solution. At this time, additives such as bases, acids, surfactants, etc., can be added together. Further, ultrasonic waves can also be used for dissolution. For adding these compounds, a method of dissolving the compounds in a volatile organic solvent, dispersing the solution in a hydrophilic colloid and adding this dispersion to an emulsion as disclosed in U.S. Pat. No. 3,469,987, a method of dispersing these compounds in a water-soluble solvent and adding the dispersion to an emulsion as disclosed in JP-B-46-24185, a method of dissolving these compounds in a surfactant and adding the solution to an emulsion as disclosed in U.S. Pat. No. 3,822,135, a method of dissolving these compounds with a compound capable of red-shifting and adding the solution to an emulsion as disclosed in JP-A-51-74624, a method of dissolving these compounds in an acid not substantially containing water and adding the solution to an emulsion as disclosed in JP-A-50-80826 can be used. Besides the above methods, the methods disclosed in U.S. Pat. Nos. 2,912,343, 3,342,605, 2,996,287 and 3,429,835 can also be used.

Any of silver bromide, silver iodobromide, silver chlorobromide, silver iodide, silver iodochloride, silver iodobromochloride and silver chloride can be in a silver halide photographic emulsion concerning the light-sensitive mechanism according to the present invention, but preferably the halogen composition of the outermost surface of an emulsion contains 0.1 mol % or more iodide. The grain size distribution may be broad or narrow but is preferably narrow.

The silver halide grains contained in a photographic emulsion may have a regular crystal form, such as cubic, octahedral, tetradecahedral, or rhombic dodecahedral, an irregular crystal form, such as spherical or plate-like, hkl planes, or a composite form of these crystal forms, but the silver halide grains according to the present invention are preferably tabular grains. Tabular grains are described in detail later. With respect to the silver halide grains having the hkl planes, *Journal of Imaging Science*, Vol. 30, pp. 247 to 254 (1986) can be referred to.

The above-described silver halide grains may be used in the silver halide photographic emulsions according to the present invention alone or in combination of two or more. The interiors and the surfaces of the silver halide grains may be composed of different phases, the silver halide grains may be composed of multi-phase structures having conjugated structures, may have local phases on the surfaces, the grains may be composed of uniform phases, or may be composed of the mixtures of these.

The emulsions may be of the surface latent image type wherein the latent image is primarily formed on the surface, or of the internal latent image type wherein the latent image is formed within the grains.

The silver halide emulsions for use in the present invention are preferably tabular silver halide grains adsorbed with the sensitizing dyes of the present invention and having higher surface area/volume ratio.

Tabular grains have two main planes parallel to each other and side planes joining these main planes as outer faces. Tabular grains are grains having one twin plane or two or more parallel twin planes, and in this case if all lattice point ions are in mirror image relationship on both sides of {111} face, this {111} face is called twin plane. The main plane of a tabular grain looks like a triangular, hexagonal or rounded shape of triangle or hexagon when viewed in the vertical direction to main plane of the grain, and they are a triangular grain, a hexagonal grain and circular grain respectively.

An aspect ratio of a tabular grain is defined as the ratio of the diameter to the thickness of a silver halide grain, i.e., an aspect ratio is the value obtained by dividing the diameter of each silver halide grain by the thickness. The diameter here means a diameter of a circle having the same area as the projected area of a grain when observed with a microscope or an electron microscope and is called an equivalent-circle diameter. Therefore, "an aspect ratio of 5 or more" means that the equivalent-circle diameter is 5 or more times the thickness.

As one example of measuring method of an aspect ratio, a method of calculating the equivalent-circle diameter and the thickness of each grain from a transmission electro-microphotograph due to the replica method is available. In this case, the thickness of a grain is calculated from the length of the shadow of the replica.

The tabular grains used preferably in the present invention are preferably tabular grains in which grains having an aspect ratio of 5 or more, more preferably 7 or more, and still more preferably 10 or more, account for 60% or more of the projected area. If an aspect ratio is too high, the variation coefficient of grain size distribution becomes large, hence an aspect ratio is in general preferably 30 or less.

In the silver halide grains for use in the present invention, tabular grains account for preferably 60% or more of the projected area, more preferably 80% or more. If the ratio of tabular grains is less than 60%, photographic properties are seriously deteriorated, thus the present invention cannot be achieved.

The equivalent-sphere diameter of the tabular grains for use in the present invention is preferably 5.0 μm or less, more preferably from 0.2 to 3.0 μm. "Equivalent-sphere diameter" means a diameter of a sphere having the same volume as the volume of a tabular grain.

The tabular grains for sue in the present invention are preferably monodispersed tabular grains. The structure and producing method of monodispersed tabular grains are as disclosed, e.g., in JP-A-63-151618. Briefly, monodispersed tabular grain means that 70% or more of the entire projected area of the silver halide grains are occupied by tabular grains of a hexagonal shape having the ratio of the length of the side having the longest length to the length of the side having the shortest length of 2 or less and having two parallel faces as outer faces, and the variation coefficient of the grain size distribution of the hexagonal tabular grains [the value obtained by dividing the grain size dispersion represented by equivalent-circle diameter of the projected area (standard deviation) by the average grain size] is monodispersion of 20% or less, preferably 18% or less.

The tabular grains for sue in the present invention preferably have a thickness of less than about 0.5 μm, more preferably from 0.05 to 0.2 μm, and still more preferably from 0.05 to 0.07 μm. The variation coefficient of the thickness distribution is preferably monodispersion of 20% or less.

The distance between the twin planes of the tabular grains for use in the present invention is preferably 0.017 μm or less, more preferably from 0.007 to 0.017 μm, and particularly preferably from 0.007 to 0.015 μm.

The distance between the twin planes is preferably monodispersion. The variation coefficient of the distance between the twin planes of the tabular grains [the value obtained by dividing the dispersion of the distance between the twin planes (standard deviation) by the average distance between the twin planes] is preferably monodispersion of 40% or less, more preferably 30% or less, and still more preferably 20% or less.

The average silver iodide content of the silver halide grains for use in the present invention is preferably from 1 to 12 mol %, more preferably from 1 to 10 mol %.

The average silver iodide content of the silver halide grains can be measured, for example, by analyzing the composition of the grain one by one by means of an X-ray microanalyzer The average silver iodide content is the arithmetic mean of the value obtained by measuring the silver iodide content of at least 100 emulsion grains with an X-ray microanalyzer. The specific method of measuring the silver iodide content of individual emulsion grain is disclosed, e.g., in EP-A-147868.

The silver halide grains for sue in the present invention preferably have dislocation lines.

The dislocation lines of tabular grains can be observed directly with the transmission type electron microscope at low temperature as disclosed, e.g., in J. F. Hamilton, *Phot. Sci. Eng.,* 11, 57 (1967) and T. Shiozawa, *J. Soc. Photo. Sci. Japan,* 35, 213 (1972).

That is, silver halide grains taken out from an emulsion with a care so as not to apply such a pressure as generates dislocation lines on the grains are put on a mesh for observation by an electron microscope, and observation is performed by a transmission method with the sample being in a frozen state so as to prevent the damage by an electron beam (e.g., printout) from being generated. At this time, the thicker the thickness of the grain, the more difficult is the electron beam to be transmitted. Accordingly, it is preferred to use a high pressure type electron microscope (200 kV or more with the grains of the thickness of 0.25 μm) for observing clearly. Further, since dislocation lines are seen or not seen according to the angle of inclination of the sample to the electron beam, it is necessary for observing dislocation lines to photograph one and the same grain many times as far as possible with varying the angle of inclination of the sample to confirm the existing positions of dislocation lines.

The tabular grains for use in the present invention preferably have ten or more dislocation lines per one grain.

A tabular grain may have dislocation lines on the entire periphery almost uniformly, or may have dislocation lines locally on the periphery. That is, taking a hexagonal tabular grain as an example, dislocation lines may be limited to be introduced only in the vicinity of six vertexes, or may be limited to only the vicinity of one vertex. Contrary to these, it is possible to limit the introduction of dislocation lines only to the sides exclusive of the vicinity of six vertexes. Further, dislocation lines may be formed on two main planes of a tabular grain.

In the present invention, tabular silver halide grains having halogen composition comprising silver chloride, silver bromide, silver chlorobromide, silver iodobromide, silver chloroiodobromide or silver iodochloride are preferably used. The tabular grains having {100} or {111} main planes are preferably used. Tabular grains having {111} main planes (hereinafter referred to as {111} tabular grains)

have generally triangular or hexagonal planes. In general, the more uniform the grain size distribution, the higher is the ratio of tabular grains having hexagonal planes. Hexagonal monodispersed tabular grains are disclosed in JP-B-5-61205.

Tabular grains having {100} main planes (hereinafter referred to as {100} tabular grains) have rectangular or square shapes. In this emulsion, grains having a ratio of adjacent side lengths of less than 5/1 as compared with acicular grains are called tabular grains. In silver chloride tabular grains or high silver chloride content tabular grains, {100} tabular grains are originally high in main plane stability as compared with {111} tabular grains. With {111} tabular grains, it is essential to stabilize {111} main plane, and JP-A-9-80660, JP-A-9-80656 and U.S. Pat. No. 5,298,388 can be referred to.

Silver chloride {111} tabular grains or high silver chloride content {111} tabular grains for use in the present invention are disclosed in U.S. Pat. Nos. 4,414,306, 4,400,463, 4,713,323, 4,783,398, 4,962,491, 4,983,508, 4,804,621, 5,389,509, 5,217,858 and 5,460,934.

High silver bromide content {111} tabular grains which are used in the present invention are disclosed in U.S. Pat. Nos. 4,425,425, 4,425,426, 4,434,226, 4,439,520, 4,414,310, 4,433,048, 4,647,528, 4,665,012, 4,672,027, 4,678,745, 4,684,607, 4,593,964, 4,722,886, 4,722,886, 4,755,617, 4,755,456, 4,806,461, 4,801,522, 4,835,322, 4,839,268, 4,914,014, 4,962,015, 4,977,074, 4,985,350, 5,061,609, 5,061,616, 5,068,173, 5,132,203, 5,272,048, 5,334,469, 5,334,495, 5,358,840 and 5,372,927.

{100} Tabular grains for use in the present invention are disclosed in U.S. Pat. Nos. 4,386,156, 5,275,930, 5,292,632, 5,314,798, 5,320,938, 5,319,635, 5,356,764, European Patents 569971, 737887, JP-A-6-308648 and JP-A-9-5911.

Gelatin is preferably used as a protective colloid at the time of preparation of the emulsions of the present invention and as a binder for other hydrophilic colloid layers, but other hydrophilic colloids can also be used.

Examples thereof include proteins such as gelatin derivatives, graft polymers of gelatin and other high polymers, albumin and casein; sugar derivatives such as cellulose derivatives, e.g., hydroxyethyl cellulose, carboxymethyl cellulose, and cellulose sulfate, sodium alginate, and starch derivatives; and various kinds of synthetic hydrophilic high polymers of homopolymers or copolymers such as polyvinyl alcohol, partially acetalated polyvinyl alcohol, poly-N-vinyl pyrrolidone, polyacrylic acid, polymethacrylic acid, polyacrylamide, polyvinylimidazole, and polyvinylpyrazole.

Acid-processed gelatin and enzyme-processed gelatin disclosed in *Bull. Soc. Sci. Photo. Japan*, No. 16, p. 30 (1966) can be used as well as lime-processed gelatin, and hydrolyzed product and enzyme decomposed product of gelatin can also be used.

The silver halide emulsions for use in the present invention are preferably washed with water for the purpose of desalting and dispersed in a newly prepared protective colloid. The washing temperature can be selected according to the purpose but is preferably from 5 to 50° C. The pH at washing time can also be selected according to the purpose but is preferably from 2 to 10, more preferably from 3 to 8. The pAg at washing time can also be selected according to the purpose but is preferably from 5 to 10. The washing method can be selected from among a noodle washing method, a dialysis method using a semi-permeable membrane, a centrifugal separation method, a coagulation precipitation method, and an ion exchange method. In the case of a coagulation precipitation method, the washing method can be selected from among a method using sulfate, a method using an organic solvent, a method using a water-soluble polymer, a method using a gelatin derivative, etc.

It is preferred for the silver halide emulsion grains used in the present invention to contain metal ion salts, according to purposes, during preparation, e.g., at the time of grain formation, during desalting process, during chemical sensitization or before coating. When grains are doped, they are preferably added during grain formation, and when the surfaces of grains are modified or when metal ion salts are used as chemical sensitizers, they are preferably added after grain formation and before completion of chemical sensitization. A method of doping can be selected such that a grain is entirely doped, a core part is partially doped, only a shell part is doped, only an epitaxial part is doped, or only substrate grains are doped. Examples of the metals which can be used include Mg, Ca, Sr, Ba, Al, So, Y, La, Cr, Mn, Fe, Co, Ni, Cu, Zn, Ga, Ru, Rh, Pd, Re, Os, Ir, Pr, Au, Cd, Hg, Tl, In, Sn, Pb, Bi, etc. These metals can be added in the form of a salt capable of being dissolved at the time of grain formation, e.g., ammonium salt, acetate, nitrate, sulfate, phosphate, a hydroxy acid salt, or a six-coordinated complex salt or a four-coordinated complex salt, e g., $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN)_5]$, $K_3IrCl_5$, $(NH_4)_3RhCl_6$, $K_4Ru(CN)_6$, etc. A ligand of a coordination compound can be selected from halo, aquo, cyano, cyanate, thiocyanate, nitrosyl, thionitrosyl, oxo and carbonyl. They may comprise only one kind of a metal compound or may comprise two, three or more metal compounds in combination.

Metal compounds are preferably dissolved in water or an appropriate solvent such as methanol or acetone. For stabilizing the solution, a method of adding an aqueous solution of hydrogen halide (e.g., HCl, HBr) or an aqueous solution of alkali halide (e.g., KCl, NaCl, KBr, NaBr) to the solution can be used. If desired, acid or alkali may be added. Metal compounds can be added to a reaction vessel before grain formation or may be added during grain formation. Metal compounds can also be added to a water-soluble silver salt (e.g., $AgNO_3$) or an aqueous solution of alkali halide (e.g., NaCl, KBr, Kl) and added to a reaction solution continuously during silver halide grain formation. Further, metal compounds may be added as a separate solution independently from a water-soluble silver salt or an alkali halide and added continuously at a proper time during grain formation. It is also preferred to use various addition methods in combination.

As disclosed in U.S. Pat. No. 3,772,031, there are cases where a method in which the chalcogenide compounds are added during the emulsion formation is useful. Cyan salt, thiocyan salt, selenocyanic acid, carbonate, phosphate and acetate can be present as well as S, Se and Te.

A silver halide emulsion is in general chemically sensitized before use. As chemical sensitization, chalcogen sensitization (sulfur sensitization, selenium sensitization, tellurium sensitization), noble metal sensitization (gold sensitization) and reduction sensitization are used alone or in combination.

Reduction sensitization can be preferably used in the present invention. Reduction sensitization is described below.

Reduction sensitization is in some cases performed during grain formation, after grain formation and before or during chemical sensitization, or after chemical sensitization, but when gold sensitization is performed in combination, it is preferred to perform reduction sensitization prior to chemical sensitization so that undesired fog does not occur. The most preferred method is to perform reduction sensitization during silver halide grain growth. "During grain growth" used herein include a method of performing reduction sensitization while silver halide grains are growing by physical ripening or by the addition of a water-soluble silver salt and a water-soluble alkali halide, and a method of performing reduction sensitization after temporarily stopping grain growth during the growth and then further continuing the growth. The method of the reduction sensitization can be selected from a method of adding a reduction sensitizer to a silver halide emulsion, a method of growing or ripening grains in the atmosphere of low pAg of from 1 to 7 which is called silver ripening, or a method of growing or ripening grains in the atmosphere of high pH of from 8 to 11 which is called high pH ripening. Further, two or more of these methods can be used in combination.

A method of adding a reduction sensitizer is preferred from the point of capable of delicately controlling the level of the reduction sensitization. Stannous salt, ascorbic acid and derivatives thereof amines and polyamines, hydrazine derivatives, formamidinesulfinic acid, silane compounds and borane compounds are well known as a reduction sensitizer. These well-known reduction sensitizers can be selected and used in the present invention, and two or more of these compounds can also be used in combination. Stannous chloride, thiourea dioxide, dimethylamineborane, ascorbic acid and derivatives thereof are preferred compounds as a reduction sensitizer. As the addition amount of reduction sensitizers depends upon the production conditions of the emulsion, the addition amount needs to be selected, but $10^{-7}$ to $10^{-3}$ mol per mol of the silver halide is preferably used.

Reduction sensitizers are added by being dissolved in water or a solvent such as alcohols, glycols, ketones, esters or amides. Reduction sensitizers may be previously added to a reaction vessel, but the addition at proper time during grain growth is more preferred. Further, reduction sensitizers may be added in advance to an aqueous solution of water-soluble silver salt or an aqueous solution of water-soluble alkali halide and silver halide grains may be precipitated using these aqueous solutions. Further, the solution of the reduction sensitizers may be divided to several parts and added in several times or may be added continuously over a long period of time with the degree of the grain growth.

As a means to terminate reduction sensitization, there are a method of terminating silver ripening by increasing the pAg, a method of terminating high pH ripening by lowering the pH, and a method of terminating reduction sensitization by adding an oxidant. Of these methods, a method of using an oxidant is a preferred method. An oxidant used in the present invention is a compound having a function of acting on metallic silver and converting it to a silver ion. In particular, a compound which can convert superminute silver grains by-produced in the course of silver halide grain formation and in the course of chemical sensitization to a silver ion is effective. The silver ion converted may form sparingly water-soluble silver salt such as silver halide, silver sulfide or silver selenide, or may form easily water-soluble silver salt such as silver nitrate. An oxidant for silver may be inorganic or organic. Examples of inorganic oxidants include oxyacid salt, such as ozone, hydrogen peroxide and addition products thereof (e.g., $NaBO_2.H_2O_2.3H_2O$, $2NaCO_3.3H_2O_2$, $Na_4P_2O_7.2H_2O_2$, $2Na_2SO_4.H_2O_2.2H_2O$), peroxyacid salt (e.g., $K_2S_2O_8$, $K_2C_2O_6$, $K_2P_2O_8$), peroxy complex compound (e.g., $K_2[Ti(O_2)C_2O_4]3H_2O$, $4K_2SO_4.Ti(O_2)OH.SO_4.2H_2O$, $Na_3[VO\ O_2)(C_2H_4)_2].6H_2O$), permanganate (e.g., $KMnO_4$), and chromate (e.g., $K_2Cr_2O_7$) halogen element such as iodine and bromine, perhalogeno acid salt (e.g., potassium periodate), salt of metal of high valency (e.g., potassium hexacyanoferrate (III)), and thiosulfonate.

Further, examples of organic oxidants include quinones such as p-quinone, organic peroxides such as peracetic acid and perbenzoic acid, compounds which release active halogen (e.g., N-bromosuccinimide, chloramine T, chloramine B).

Oxidants which are preferably used in the present invention are inorganic oxidants such as ozone, hydrogen peroxide and addition products thereof, a halogen element and thiosulfonate, and organic oxidants such as quinones. It is preferred to use the above-described reduction sensitization in combination with an oxidant for silver. The method of usage can be selected from a method in which an oxidant is used and then reduction sensitization is performed, an inverse method thereof, or a method in which both are concurred with. These methods can be selectively used in the courses of grain formation and chemical sensitization. However, even in these methods, reduction sensitization can be substantially terminated by further using an oxidant before formation of dislocation lines after performing reduction sensitization.

In the present invention, at least selenium-sensitized silver halide emulsions are preferably used. That is, selenium sensitization alone, combinations of selenium sensitization and other chalcogen sensitization and/or noble metal sensitization (in particular, gold sensitization) are preferred, and combination of selenium sensitization and noble metal sensitization is particularly preferred.

Labile selenium compounds are used in selenium sensitization as a sensitizer. Labile selenium compounds are disclosed in JP-B-43-13489, JP-B-44-15748, JP-A-4-25832, JP-A-4-109240, JP-A-4-271341, and JP-A-5-40324. Examples of selenium sensitizers include colloidal metallic selenium, selenoureas (e.g., N,N-dimethylselenourea, trifluoromethylcarbonyltrimethylselenourea, acetyltrimethylselenourea), selenoamides (e.g., selenoacetamide, N,N-diethylphenylselenoamide), phosphineselenides (e.g., triphenylphosphineselenide, pentafluorophenyltriphenylphosphineselenide), selenophosphates (e.g., tri-p-tolylselenophosphate, tri-n-butylselenophosphate), seleno ketones (e.g., selenobenzophenone), isoselenocyanates, selenocarboxylic acids, seleno esters, and diacylselenides. In addition, comparatively stable selenium compounds such as selenious acid, potassium selenocyanide, selenazoles and selenides (disclosed in JP-B-46-4553 and JP-B-52-34492) can also be used as a selenium sensitizer.

Labile sulfur compounds are used in sulfur sensitization as a sensitizer. Labile sulfur compounds are disclosed in P. Glafkides, *Chimie et Physique Photographique,* 5th Ed., Paul Montel (1987) and *Research Disclosure*, Vol. 307, No. 307105. Examples of sulfur sensitizers include thiosulfates (e.g., hypo) thioureas (e.g., diphenylthiourea, triethylthiourea, N-ethyl-N'-(4-methyl-2-thiazolyl)thiourea, carboxymethyltrimethylthiourea), thioamides (e.g., thioacetamide), rhodanines (e.g., diethyl rhodanine, 5-benzylidene-N-ethyl rhodanine), phosphine sulfides (e.g., trimethylphosphine sulfide), thiohydantoins, 4-oxooxazolidine-2-thiones, dipolysulfides (e.g., dimorpholine disulfide, cystine, hexathiocan-thione), mercapto compounds (e.g., cysteine), polythionate, and elemental sulfur. Active gelatins can also be used as a sulfur sensitizer.

Labile tellurium compounds are used in tellurium sensitization as a tellurium sensitizer. Labile tellurium compounds are disclosed in Canadian Patent 800,958, British Patents 1,295,462, 1,396,696, JP-A-4-204640, JP-A-4-271341, JP-A-4-333043, and JP-A-5-303157. Examples of tellurium sensitizers include telluroureas (e.g., tetramethyltellurourea, N,N'-dimethylethylenetellurourea, N,N'-diphenylethylenetellurourea), phosphinetellurides (e.g., butyldiisopropylphosphinetelluride, tributylphosphinetelluride, tributoxyphosphinetelluride, ethoxydiphenylphosphinetelluride), diacyl(di)tellurides (e.g., bis(diphenylcarbamoyl)ditelluride, bis(N-phenyl-N-methylcarbamoyl)-ditelluride, bis(N-phenyl-N-methylcarbamoyl)telluride, bis(ethoxycarbonyl)telluride), isotellurocyanatos, telluroamides, tellurohydrazides, telluro esters (e.g., butylhexyltelluro ester), telluro ketones (e.g., telluroacetophenone), colloidal tellurium, (di)tellurides, and other tellurium compounds (e.g., potassium telluride, sodium telluropentathionate).

Noble metal salts of gold, platinum, palladium and iridium are used as a sensitizer in noble metal sensitization. Noble metal salts are described in P. Glafkides, *Chimie et Physique Photographique,* 5th Ed., Paul Montel (1987) and Research Disclosure, Vol. 307, No. 307105. Gold sensitization is particularly preferred. As described above, the effect of the present invention is particularly exhibited when gold sensitization is performed.

Examples of gold sensitizers include chloroauric acid, potassium chloroaurate, potassium aurithiocyanate, gold sulfide, and gold selenide, as well as gold compounds disclosed in U.S. Pat. Nos. 2,642,361, 5,049,484 and 5,049,485.

The amount of sensitizers is in general determined on the basis of the kind of silver halide grains to be used and the conditions of chemical sensitization.

The use amount of chalcogen sensitizers is generally from $10^{-8}$ to $10^{-2}$ mol, preferably from $10^{-7}$ to $5\times10^{-3}$ mol, per mol of the silver halide.

The use amount of noble metal sensitizers is preferably from $10^{-7}$ to $10^{-2}$ mol per mol of the silver halide.

The conditions of chemical sensitization are not particularly limited. pAg is in general from 6 to 11, preferably from 7 to 10, pH is preferably from 4 to 10, and temperature is preferably from 40 to 95° C., and more preferably from 45 to 85° C.

The disclosure in JP-A-10-239789, from line 36, column 63 to line 2, column 65 can be applied to the producing method of the photographic emulsions for use in the present invention.

The light-sensitive material of the present invention can comprise at least one light-sensitive layer on a support. In a typical embodiment, the silver halide photographic material of the present invention comprises at least one light-sensitive layer consisting of a plurality of silver halide emulsion layers having substantially the same color sensitivity but different degrees of light-sensitivities on a support. The light-sensitive layer is a unit light-sensitive layer having a color sensitivity to any of blue light, green light and red light. In the multilayer silver halide color photographic material, these unit light-sensitive layers are generally arranged in the order of red-sensitive layer, green-sensitive layer and blue-sensitive layer from the support side. However, the order of the arrangement can be reversed depending on the purpose, alternatively, the light-sensitive layers may be arranged in such a way that a layer having a different light-sensitivity is interposed between layers having the same color sensitivity. Light-insensitive layers may be provided between the above-described silver halide light-sensitive layers, and on the uppermost layer and beneath the lowermost layer of the silver halide light-sensitive layers. These light-insensitive layers may contain couplers, DIR compounds and color mixing preventives described below. It is preferred for the plurality of silver halide emulsion layers constituting each unit light-sensitive layer to take the arrangement of a two-layer structure of a high-speed emulsion layer and a low-speed emulsion layer decreasing in sensitivity toward a support in turn as disclosed in German Patent 1,121,470 and British Patent 923,045. In addition, a low-speed emulsion layer may be provided farther from the support and a high-speed emulsion layer may be provided nearer to the support as disclosed in JP-A-57-112751, JP-A-62-200350, JP-A-62-206541 and JP-A-62-206543.

In one specific example, a low-speed blue-sensitive layer (BL)/a high-speed blue-sensitive layer (BH)/a high-speed green-sensitive layer (GH)/a low-speed green-sensitive layer (GL)/a high-speed red-sensitive layer (RH)/a low-speed red-sensitive layer (RL), or BH/BL/GL/GH/RH/RL, or BH/BL/GH/GL/RL/RH can be arranged in this order from the side farthest from the support.

A blue-sensitive layer/GH/RH/GL/RL can be arranged in this order from the side farthest from the support as disclosed in JP-B-55-34932. Further, a blue-sensitive layer/GL/RL/GH/RH can be arranged in this order from the side farthest from the support as disclosed in JP-A-56-25738 and JP-A-62-63936.

Further, useful arrangements include the arrangement constituted of three layers having different degrees of sensitivities with the sensitivity being lower towards the support such that the uppermost layer is a silver halide emulsion layer having the highest sensitivity, the middle layer is a silver halide emulsion layer having a lower sensitivity than that of the uppermost layer, and the lowermost layer is a silver halide emulsion layer having a lower sensitivity than that of the middle layer, as disclosed in JP-B-49-15495. In the case of the structure of this type comprising three layers having different degrees of sensitivities, the layers in the unit layer of the same color sensitivity may be arranged in the order of a middle-speed emulsion layer/a high-speed emulsion layer/a low-speed emulsion layer from the side farthest from the support, as disclosed in JP-A-59-202464.

Alternatively, the layers can be arranged in the order of a high-speed emulsion layer/a low-speed emulsion layer/a middle-speed emulsion layer, or a low-speed emulsion layer/a middle-speed emulsion layer/a high-speed emulsion layer Moreover, the arrangement may be varied as indicated above in the case where there are four or more layers.

As materials giving an interlayer effect, compounds which release development inhibitors or precursors thereof by reaction with the oxidized product of a developing agent obtained by development are used, e.g., DIR (development inhibitor-releasing) couplers, DIR-hydroquinone, couplers which release DIR-hydroquinone or precursors thereof, are used. When development inhibitors have large diffusibility, a development inhibiting effect can be obtained irrespective of the position of the donor layer in interlayer multilayer constitution, but a development inhibiting effect is also given in the direction not intended, therefore, it is preferred to color-form the donor layer (e.g., the same color as the color of the layer which is influenced by the development inhibitor). For the light-sensitive material to obtain desired spectral sensitivity, it is preferred to color-form the donor layer giving an interlayer effect magenta.

The size and shape of the silver halide grains used in a layer giving an interlayer effect to a red-sensitive layer are not particularly restricted but tabular grains having a high aspect ratio, monodispersed emulsions having uniform grain sizes, and silver iodobromide grains having the layered structure of iodide are preferably used. It is preferred to mix two or more emulsions having different grain sizes for the purpose of expanding exposure latitude.

A donor layer giving an interlayer effect to a red-sensitive layer may be coated in any position of the support but it is preferred to provide the donor layer nearer to the support than a blue-sensitive layer and farther from the support than a red-sensitive layer, and it is more preferred to provide the donor layer nearer to the support than a yellow filter layer.

A donor layer giving an interlayer effect to a red-sensitive layer is more preferably positioned nearer to the support than a green-sensitive layer and farther from the support than a red-sensitive layer, and most preferably the position of the donor layer is adjacent to a green-sensitive layer on the side nearer to the support. The term "adjacent to" means that an interlayer, etc., does not intervene between the support and the green-sensitive layer.

A layer giving an interlayer effect to a red-sensitive layer may be comprise a plurality of layers, and in such a case, a plurality of layers may be adjacent to each other or may be apart from each other.

The emulsions for use in the photographic materials of the present invention may be of the surface latent image type wherein the latent image is primarily formed on the surface, or of the internal latent image type wherein the latent image is formed inside the grains, or of a type wherein the latent image is formed both at the surface and inside the grains, but it is essential to be a negative type emulsion. Of the internal latent image types, the emulsion may be a core/shell type internal latent image type emulsion as disclosed in JP-A-63-264740, and a method for preparation of such a core/shell type internal latent image type emulsion is disclosed in JP-A-59-133542. The thickness of the shell of this emulsion varies depending upon the development process, but is preferably from 3 to 40 nm, and particularly preferably from 5 to 20 nm.

The silver halide emulsions for use in the present invention is usually subjected to physical ripening, chemical ripening and spectral sensitization before use. Additives for use in such processes are disclosed in RD No. 17643, RD, No. 18716, and RD, No. 307105, and the locations of these disclosures are summarized in a table described below.

In the photographic material of the present invention, two or more different types of emulsions which are different in terms of at least one of the characteristics of grain size, grain size distribution, halogen composition, the shape of grains, or light sensitivity of the light-sensitive silver halide emulsion can be used in admixture in the same layer.

It is preferred to use the silver halide grains having a fogged grain surface as disclosed in U.S. Pat. No. 4,082,553, the silver halide grains having a fogged grain interior as disclosed in U.S. Pat. No. 4,626,498 and JP-A-59-214852, or colloidal silver in light-sensitive silver halide emulsion layers and/or substantially light-insensitive hydrophilic colloid layers. Silver halide grains having a fogged grain interior or surface are silver halide grains which can be developed uniformly (not imagewise) irrespective of whether these grains are in an unexposed part or an exposed part of the photographic material, and methods for the preparation thereof are disclosed in U.S. Pat. No. 4,626,498 and JP-A-59-214852. The silver halide which forms the internal nuclei of a core/shell type silver halide grains having a fogged grain interior may have different halogen compositions. The silver halide having a fogged grain interior or surface may be any of silver chloride, silver chlorobromide, silver iodobromide, or silver chloroiodobromide. The average grain size of these fogged silver halide grains is preferably from 0.01 to 0.75 $\mu$m, and particularly preferably from 0.05 to 0.6 $\mu$m. Further, the shape of the grains may be regular grains and may be a polydispersed emulsion, but a monodispersed emulsion (at least 95% of which have a grain size within ±40% of the average grain size in terms of the mass or number of silver halide grains) is preferred.

The use of light-insensitive fine grained silver halides is preferred in the present invention. Light-insensitive fine grained silver halides are fine grained silver halides which are not sensitive to light upon imagewise exposure for obtaining color images and which do not substantially undergo development during development processing, and they are preferably not pre-fogged. The fine grained silver halide has a silver bromide content of from 0 to 100 mol %, and may contain silver chloride and/or silver iodide, if necessary. The fine grained silver halides which have a silver iodide content of from 0.5 to 10 mol % are preferred. The average grain size of the fine grained silver halide (the average value of the equivalent-circle diameters of the projected areas) is preferably from 0.01 to 0.5 $\mu$m, more preferably from 0.02 to 0.2 $\mu$m.

The fine grained silver halide can be prepared by the same methods as the preparation of generally used light-sensitive silver halides. In the preparation of the fine grained silver halide, the surfaces of the silver halide grains do not need to be optically sensitized and also do not need to be spectrally sensitized. However, it is preferred to previously add known stabilizers such as triazole based, azaindene based, benzothiazolium based, or mercapto based compounds, or zinc compounds to the fine grained silver halide before addition to the coating solution. Colloidal silver can be added to the layer containing the fine grained silver halide grains.

The above-described various additives are used in the photographic materials according to the present invention but besides the above-described compounds various other additives can be used according to purposes.

These additives are described in detail in *Research Disclosure*, Item 17643 (December, 1978), ibid., Item 18716 (November, 1979) and ibid., Item 308119 (December, 1989). The locations corresponding thereto are indicated in the table below.

| | Type of Additives | RD 17643 | RD 18716 | RD 308119 |
|---|---|---|---|---|
| 1. | Chemical Sensitizer | page 23 | page 648, right column | page 996 |
| 2. | Sensitivity Increasing Agents | — | page 648, right column | — |
| 3. | Spectral Sensitizers and Supersensitizers | pages 23–24 | page 648, right column to page 649, right column | page 996, right column to page 998 right column |
| 4. | Brightening Agents | page 24 | — | page 998, right column |
| 5. | Antifoggants and Stabilizers | pages 24–15 | page 649, right column | page 998, right column to page 1000, right column |
| 6. | Light Absorbers, Filter Dyes, and Ultraviolet Absorbers | pages 25–26 | page 649, right column to page 650, left column | page 1003, left column to page 1003, right column |

-continued

| | Type of Additives | RD 17643 | RD 18716 | RD 308119 |
|---|---|---|---|---|
| 7. | Antistaining Agents | page 25, right column | page 650, left to right columns | page 1002, right column |
| 8. | Color image Stabilizers | page 25 | — | page 1002, right column |
| 9. | Hardening Agents | page 26 | page 651, left column | page 1004, right column to page 1005, left column |
| 10. | Binders | page 26 | page 651, left column | page 1003 right column to page 1004, right right column |
| 11. | Plasticizers and Lubricants | page 27 | page 650, right column | page 1006, left to right column |
| 12. | Coating Aids and Surfactants | pages 26–27 | page 650, right column | page 1005, left column to page 1006, left column |
| 13. | Antistatic Agents | page 27 | page 650, right column | page 1006, right column to page 1007, left column |
| 14. | Matting Agent | — | — | page 1008, left column to page 1009, left column |

The emulsion according to the present invention, and techniques such as layer arrangement, silver halide emulsion, functional couplers such as dye-forming couplers and DIR couplers, various additives and the like and development processing which can be used in the photographic material using the emulsion according to the present invention are disclosed in EP-A-565096 (disclosed on Oct. 13, 1993) and the patents cited therein. Each item and corresponding locations are listed below.

| | | |
|---|---|---|
| 1. | Layer Structures | lines 23 to 35, page 61, line 41, page 61 to line 14, page 62 |
| 2. | Interlayers | lines 36 to 40, page 61 |
| 3. | Interlayer Effect Imparting Layers | lines 15 to 18, page 62 |
| 4. | Halide Compositions of Silver Halide | lines 21 to 25, page 62 |
| 5. | Crystal Habits of Silver Halide Grains | lines 26 to 30, page 62 |
| 6. | Grain Sizes of Silver Halide Grains | lines 31 to 34, page 62 |
| 7. | Producing Methods of Emulsions | lines 35 to 40, page 62 |
| 8. | Grain Size Distributions of Silver Halide Grains | lines 41 and 42, page 62 |
| 9. | Tabular Grains | lines 43 to 46, page 62 |
| 10. | Structures of Interiors of Grains | lines 47 to 53, page 62 |

-continued

| | | |
|---|---|---|
| 11. | Latent Image Forming Types of Emulsions | lines 54, page 62 to line 5, page 63 |
| 12. | Physical Ripening and Chemical Sensitization of Emulsions | lines 6 to 9, page 63 |
| 13. | Mixed Usage of Emulsion | lines 10 to 13, page 63 |
| 14. | Fogged Emulsions | lines 14 to 31, page 63 |
| 15. | Light-Insensitive Emulsions | lines 32 to 43, page 63 |
| 16. | Coating Amount of Silver | lines 49 and 50, page 63 |
| 17. | Formaldehyde Scavengers | lines 54 to 57, page 64 |
| 18. | Mercapto-Based Antifoggants | lines 1 and 2, page 65 |
| 19. | Releasing Agents of Antifoggants and the like | lines 3 to 7, page 65 |
| 20. | Dyes | lines 7 to 10, page 65 |
| 21. | Color Couplers in General | lines 11 to 13, page 65 |
| 22. | Yellow, Magenta and Cyan Couplers | lines 14 to 25, page 65 |
| 23. | Polymer Couplers | lines 26 to 28, page 65 |
| 24. | Diffusible Dye-Forming Couplers | lines 29 to 31, page 65 |
| 25. | Colored Couplers | lines 32 to 38, page 65 |
| 26. | Functional Couplers in General | lines 39 to 44, page 65 |
| 27. | Bleaching Accelerator-Releasing Couplers | lines 45 to 48, page 65 |
| 28. | Development Accelerator-Releasing Couplers | lines 49 to 53, page 65 |
| 29. | Other DIR Couplers | lines 54, page 65 to line 4, page 66 |
| 30. | Methods of Coupler Dispersion | lines 5 to 28, page 66 |
| 31. | Preservatives, Antibacterial Agents | lines 29 to 33, page 66 |
| 32. | Kinds of Photographic Materials | lines 34 to 36, page 66 |
| 33. | Film Thickness of Light-Sensitive Layer and Film Swelling Rate | lines 40, page 66 to line 1, page 67 |
| 34. | Backing Layers | lines 3 to 8, page 67 |
| 35. | Development Processing in General | lines 9 to 11, page 67 |
| 36. | Developing Solutions and Developers | lines 12 to 30, page 67 |
| 37. | Additives for Developing Solution | lines 31 to 44, page 67 |
| 38. | Reversal Process | lines 45 to 56, page 67 |
| 39. | Open Rate of Processing Solutions | line 57, page 67 to line 12, page 68 |
| 40. | Developing Time | lines 13 to 15, page 68 |
| 41. | Blixing, Bleaching and Fixing | line 16, page 68 to line 31, page 69 |
| 42. | Automatic Processors | lines 32 to 40, page 69 |
| 43. | Washing, Rinsing and Stabilization | line 41, page 69 to line 18, page 70 |

-continued

| | | |
|---|---|---|
| 44. | Replenishment of Processing Solutions and Reuse | line 19 to 23, page 70 |
| 45. | Incorporation of Developer in Photographic Material | lines 24 to 33, page 70 |
| 46. | Temperature of Development Processing | lines 34 to 38, page 70 |
| 47. | Use in Film Equipped with Lens | lines 39 to 41, page 70 |

In addition, the bleaching solutions containing ferric salt and persulfate such as 2-pyridinecarboxylic acid or 2,6-pyridinedicarboxylic acid with ferric nitrate as disclosed in European Patent 602600 can also be preferably used in the present invention. When using these bleaching solutions, it is preferred to use a stopping process and a washing process between a color developing process and a bleaching process, and an organic acid such as acetic acid, succinic acid, or maleic acid is preferably used in a stopping solution. In addition, it is preferred for such bleaching solutions to contain an organic acid such as acetic acid, succinic acid, maleic acid, glutaric acid, or adipic acid in an amount of from 0.1 to 2 mol/liter for the purpose of pH adjustment and preventing bleaching fog.

A magnetic recording layer preferably used in the present invention is explained below.

A magnetic recording layer preferably used in the present invention is a layer coated on a support with an aqueous or organic solvent based coating solution comprising magnetic particles dispersed in a binder.

Examples of the magnetic particles for use in the present invention include ferromagnetic iron oxide such as $\gamma$-$Fe_2O_3$, Co-adhered $\gamma$-$Fe_2O_3$, Co-adhered magnetite, Co-containing magnetite, ferromagnetic chroimium dioxide, ferromagnetic metal, ferromagnetic alloy, hexagonal system Ba ferrite, Sr ferrite, Pb ferrite, and Ca ferrite. Co-adhered ferromagnetic iron oxide such as Co-adhered $\gamma$-$Fe_2O_3$ is preferred. The shape of the particle may be any of acicular shape, an ellipsoidal shape, a spherical shape, a cubic shape, or a plate-like shape. The specific surface area ($S_{BET}$) is preferably 20 $m^2/g$ or more, and particularly preferably 30 $m^2/g$ or more.

The saturation magnetization ($\sigma_s$) of the ferromagnetic substance is preferably from $3.0\times10^4$ to $3.0\times10^5$ A/m and particularly preferably from $4.0\times10^4$ to $2.5\times10^5$ A/m. The ferromagnetic particles may be surface treated with silica and/or alumina and organic materials. Further, the surfaces of the magnetic particles may be treated with a silane coupling agent or a titanium coupling agent as disclosed in JP-A-6-161032. In addition, the magnetic particles the surfaces of which are covered with inorganic or organic substances as disclosed in JP-A-4-259911 and JP-A-5-81652 can also be used.

The binders which can be used for the magnetic particles include the thermoplastic resins, thermosetting resins, radiation curable resins, reactive type resins, acid-degradable, alkali-degradable, or biodegradable polymers, natural polymers (e.g., cellulose derivatives, sugar derivatives), and mixtures of these compounds disclosed in JP-A-4-219569. The above described resins have a Tg of from −40° C. to 300° C., and amass (i.e., weight) average molecular weight of from 2,000 to 1,000,000. Examples of the binders include vinyl based copolymers, cellulose derivatives such as cellulose diacetate, cellulose triacetate, cellulose acetate propionate, cellulose acetate butyrate and cellulose tripropionate, acrylic resins, and polyvinyl acetal resins. Gelatin is also preferably used. Cellulose di(tri)acetate is particularly preferred. The binder can be subjected to curing treatment by adding epoxy based, aziridine based or isocyanate based crosslinking agent. Examples of the isocyanate based crosslinking agents include isocyanates such as tolylenediisocyanate, 4,4'-diphenylmethanediisocyanate, hexamethylenediisocyanate and xylylenediisocyanate, reaction products of these isocyanates with polyalcohols (e.g., a reaction product of 3 mol of tolylenediisocyanate with 1 mol of trimethylolpropane), and polyisocyanate formed by condensation of these isocyanates, and they are disclosed, e.g., in JP-A-6-59357.

The above magnetic substances are dispersed in the above binders preferably by means of, as disclosed in JP-A-6-35092, a kneader, a pin type mill, and an annular type mill, and it is also preferred to use these methods in combination. The dispersants disclosed in JP-A-5-88283 or other well-known dispersants can be used. A magnetic recording layer usually has a thickness of from 0.1 $\mu$m to 10 $\mu$m, preferably from 0.2 $\mu$m to 5 $\mu$m, more preferably from 0.3 $\mu$m to 3 $\mu$m. The mass ratio (i.e., the weight ratio) of the magnetic particles to the binder is preferably from 0.5/100 to 60/100, and more preferably from 1/100 to 30/100. The coating weight of the magnetic particles is usually from 0.005 to 3 $g/m^2$, preferably from 0.01 to 2, and more preferably from 0.02 to 0.5 $g/m^2$. A magnetic recording layer preferably has a transmitted yellow density of from 0.01 to 0.50, more preferably from 0.03 to 0.20, and particularly preferably from 0.04 to 0.15. A magnetic recording layer can be provided on the back surface of a photographic support entirely or in stripe by coating or printing. Coating of a magnetic recording layer can be effected by means of air doctor coating, blade coating, air knife coating, squeeze coating, impregnation coating, reverse-roll coating, transfer-roll coating, gravure coating, kiss coating, cast coating, spray coating, dip coating, bar coating, or extrusion coating, and the coating solution disclosed in JP-A-5-341436 is preferably used.

A magnetic recording layer may have functions of lubrication improvement, curling adjustment, antistatic property, adhesion prevention and head abrasion, or another functional layer having these functions may be provided, and at least one kind or more of the particles are preferably abrasives of non-spherical inorganic particles having Mohs' hardness of or more. The composition of the non-spherical inorganic particle is preferably oxide such as aluminum oxide, chromium oxide, silicon dioxide, titanium dioxide, etc., carbide such as silicon carbide and titanium carbide, and fine powders such as diamond. The surface of these abrasives may be treated with a silane coupling agent or a titanium coupling agent. These particles may be added to a magnetic recording layer, or may be overcoated on a magnetic recording layer (e.g., a protective layer, a lubricating layer). The above-described binders can be used at this time, preferably the same binders as the binders of the magnetic recording layer may be used. Photographic materials having magnetic recording layers are disclosed in U.S. Pat. Nos. 5,336,589, 5,250,404, 5,229,259, 5,215,874 and European Patent 466130.

The polyester supports which are preferably used in the present invention are described below, but details including photographic materials described later, processing, cartridges and examples are disclosed in Kokai-Giho, Kogi No.

94-6023 (Hatsumei-Kyokai, Mar. 15, 1994). The polyester for use in the present invention comprises diol and aromatic dicarboxylic acid as essential components, and as aromatic dicarboxylic acids, 2,6-, 1,5-, 1,4- and 2,7-naphthalenedicarboxylic acid, terephthalic acid, isophthalic acid, and phthalic acid, and as diols diethylene glycol, triethylene glycol, cyclohexanedimethanol, bisphenol A, and bisphenol can be exemplified. Polymerized polymers thereof include homopolymers such as polyethylene terephthalate, polyethylene naphthalate, polycyclohexanedimethanol terephthalate and the like. Particularly preferred polyester comprises from 50 mol % to 100 mol % of 2,6-naphthalenedicarboxylic acid. Particularly preferred above all is polyethylene 2,6-naphthalate. The average molecular weight of them is about 5,000 to 200,000. Tg of the polyester for use in the present invention is 50° C. or more, and 90° C. or more is preferred.

The polyester support is heat-treated at 40° C. or more and less than Tg, more preferably at Tg minus 20° C. or more to less than Tg for the purpose of coming to be reluctant to get curling habit. The heat treatment may be performed at constant temperature within this range or may be performed with cooling The heat treatment time is from 0.1 hours to 1,500 hours, preferably from 0.5 hours to 200 hours. The support may be subjected to the heat treatment in a roll state or in a web state while transporting. The surface of the support may be provided with concave and convex (e.g., by coating conductive inorganic fine particles such as $SnO_2$ or $Sb_2O_5$) to improve the surface state. Further, it is preferred to make some contrivances so that the edge is knurled to slightly increase the height only of the edge, thereby preventing the difference in level due to the edge from imparting the evenness of support wound thereon. The heat treatment may be performed at any stage after formation of the support, after the surface treatment, after coating a backing layer (an antistatic agent, a sliding agent, etc.), or after undercoating, but preferably performed after coating an antistatic agent.

An ultraviolet absorber may be incorporated into the polyester support. Further, light piping can be prevented by incorporating the commercially available dye or pigment for polyester such as Diaresin manufactured by Mitsubishi Kasei Corp. or Kayaset manufactured by Nippon Kayaku Co., Ltd.

To ensure adhesion of the support and the constitutional layers of the photographic material, the surface activation treatment is preferably performed, such as chemical treatment, mechanical treatment, corona discharge treatment, flame treatment, ultraviolet treatment, high frequency treatment, glow discharge treatment, active plasma treatment, laser treatment, mixed acid treatment, and ozone oxidation treatment, and preferred of these surface activation treatments are ultraviolet irradiation treatment, flame treatment, corona discharge treatment, and glow discharge treatment.

An undercoating method is described below. An undercoat layer may be a single layer or may be two or more layers. Examples of the binders for an undercoat layer include copolymers with monomers selected from vinyl chloride, vinylidene chloride, butadiene, methacrylic acid, acrylic acid, itaconic acid and maleic anhydride being starting materials, as well as polyethyleneimine, an epoxy resin, grafted gelatin, nitrocellulose and gelatin. Compounds which swell the support include resorcin and p-chlorophenol. A gelatin hardening agent for an undercoat layer include chromium salt (e.g., chrome alum) aldehydes (e.g., formaldehyde, glutaraldehyde), isocyanates, active halide compounds (e.g., 2,4-dichloro-6-hydroxy-s-triazine), epichlorohydrin resins, and active vinyl sulfone compounds. $SiO_2$, $TiO_2$, inorganic fine particles or polymethyl methacrylate copolymer fine particles (from 0.01 to 10 $\mu$m) may be contained as a matting agent.

Further, antistatic agents are preferably used in the present invention. Examples of such antistatic agents include high polymers containing carboxylic acid and carboxylate, sulfonate, cationic high polymer, and ionic surfactant compounds.

The most preferred antistatic agents are fine particles of a crystalline metallic oxide of at least one particle selected from ZnO, $TiO_2$, $SnO_2$, $A1_2O_3$, $In_2O_3$, $SiO_2$, MgO, BaO, $MoO_3$ and $V_2O_5$ having a volume resistivity of $10^7\Omega\cdot$cm or less, more preferably $10^5\Omega\cdot$cm or less and having a particle size of from 0.001 to 1.0 $\mu$m or fine particles of composite oxides of them (e.g., Sb, P, B, In, S, Si, C), further, fine particles of a metal oxide in the form of sol or fine particles of these composite oxides.

The addition amount to the photographic material is preferably from 5 to 500 mg/m$^2$ and particularly preferably from 10 to 350 mg/m$^2$. The ratio of the conductive crystalline oxides or composite oxides thereof to the binder is preferably from 1/300 to 100/1 and more preferably from 1/100 to 100/5.

It is preferred for the photographic material of the present invention to have a sliding property. The sliding agent-containing layer is preferably provided on both of light-sensitive layer surface and backing layer surface. Preferred sliding property is a dynamic friction coefficient of from 0.25 to 0.01. Measurement at this time is performed by using a stainless steel ball having a diameter of 5 mm at a transporting speed of 60 cm/min (25° C., 60% RH). In this evaluation, when the opposite material is replaced with the light-sensitive layer surface, almost the same level of value can be obtained.

Examples of the sliding agents which can be used in the present invention include polyorganosiloxane, higher fatty acid amide, higher fatty acid metal salt, higher fatty acid and higher alcohol ester. As polyorganosiloxane, polydimethylsiloxane, polydiethylsiloxane, polystyrylmethylsiloxane, and polymethylphenylsiloxane can be used. The addition layer of the sliding agents is preferably the outermost layer of the emulsion layer or a backing layer. In particular, polydimethylsiloxane or esters having a long chain alkyl group are preferred.

The photographic material of the present invention preferably contains a matting agent. The matting agent may be added to either of the emulsion layer side or the backing layer side but it is particularly preferably to be added to the outermost layer of the emulsion layer. The matting agent may be either soluble or insoluble in the processing solution, preferably both types are used in combination. For example, polymethyl methacrylate, poly(methyl methacrylate/methacrylic acid=9/1 or 5/5 (mol ratio)), and polystyrene particles are preferably used. The average particle size is preferably from 0.8 to 10 $\mu$m, and particle size distribution is preferably narrow, preferably particles having particle sizes of from 0.9 to 1.1 times of the average particle size accounts for 90% or more of the entire particle number. For increasing the matting property, fine particles having a particle size of 0.8 $\mu$m or less are preferably added at the same time. For example, polymethyl methacrylate (0.2 $\mu$m), poly(methyl methacrylate/methacrylic acid=9/1 (mol ratio), 0.3 $\mu$m), polystyrene particles (0.25 $\mu$m), and colloidal silica (0.03 $\mu$m) can be exemplified.

The film patrone preferably used in the present invention is described below. The main material of the patrone for use in the present invention may be metal or synthetic plastics.

Preferred plastic materials are polystyrene, polyethylene, polypropylene, polyphenyl ether, etc. Further, the patrone for use in the present invention may contain various anti-static agents, and carbon black, metallic oxide particles, nonionic, anionic, cationic and betaine based surfactants or polymers can be preferably used. Such a patrone static prevented is disclosed in JP-A-1-312537 and JP-A-1-312538. In particular, those having the resistivity of 1012D or less at 25° C., 25% RH are preferred. Usually, a plastic patrone is produced using plastics including carbon black or a pigment to impart a light shielding property. The size of the patrone may be 135 size of the present as it is, or for miniaturizing a camera, it is effective that the diameter of the cartridge of 25 mm of the present 135 size may be decreased to 22 mm or less. The capacity of the case of the patrone is 30 $cm^3$ or less and preferably 25 cm 3or less. The mass (i.e., the weight) of the plastics used for the patrone and patrone case is preferably from 5 g to 15 g.

Further, the patrone may be a type of sending out the film by revolving a spool. Further, it may be the structure such that the tip of the film is encased in the body of the patrone and the tip of the film is sent to outside through the port of the patrone by revolving the axle of the spool in the feeding direction of the film. These structures are disclosed in U.S. Pat. Nos. 4,834,306 and 5,226,613. The photographic film for use in the present invention may be a so-called raw film before development or may be a photographic film development processed. Further, a raw film and a processed film may be contained in the same patrone, or may be stored in different patrones.

The color photographic material of the present invention is suitable for a negative film for advanced photo system (hereinafter referred to as "AP system"), and NEXIA A, NEXIA F and NEXIA H (ISO200/100/400, respectively) (manufacturedby Fuji Photo Film Co., Ltd.), which are processed as AP system format and encased in special cartridges, can be exemplified. These cartridge films for AP system are loaded on cameras for AP system, such as Epion series cameras (Epion 300Z, etc., manufactured by Fuji Photo Film Co., Ltd.). The color photographic material according to the present invention is also suitable for a film equipped with lens, e.g., Fuji Color Utsurundesu Super Slim (manufactured by Fuji Photo Film Co., Ltd.).

The film photographed by this system is printed in a mini-lab system through the following steps.

(1) Acceptance (receiving of an exposed cartridge film from customers)
(2) Detaching step (transferring of the film from the cartridge to the intermediate cartridge for development process)
(3) Development of the film
(4) Reattaching step (returning the developed film to the original cartridge)
(5) Printing (continuous automatic printing of three type prints of C/H/P and an index print on color paper (preferably SUPER FA8, manufactured by Fuji Photo Film Co., Ltd.)
(6) Checking and shipment (checking of the cartridge and the index film by ID number, and shipping with the prints)

As these systems, Fuji Film Mini-Lab Champion Super FA-298/FA-278/FA-258/FA-238, and Fuji Film Digital Lab System Frontier are preferred. As the film processors of Mini-Lab Champion, FP922AL/FP562B/FP562B, AL/FP362B/FP362B, AL can be exemplified, and as the processing chemicals, Fuji Color Just It CN-16L and CN-16Q are recommendable. As the printer processors, PP3008AR/PP3008A/PP1828AR/PP1828A/PP1258AR/PP1258A/PP728AR/PP728A can be exemplified, and as the processing chemicals, Fuji Color Just It CP-47L and CP-40FAII. In Frontier system, scanner and image processor SP-1000, and laser printer and paper processor LP-1000P or laser printer LP-1000W are used. As the detacher and the reattacher used in detaching step and reattaching step respectively, DT200/DT100 and AT200/AT100 are preferably used.

Users can enjoy AP system by photo-join system with digital image work station Aladdin 1000 (Fuji Photo Film Co., Ltd.) as the center. For example, a developed AP system cartridge film can be directly loaded on Aladdin 1000, image data of negative films, positive films and printed matters can be inputted by means of 35 mm film scanner FE-550 and flat head scanner PE-550, and the obtained image data can be easily processed and edited. The data can be outputted as printed matters by using lab equipments on hand through a digital color printer NC-550AL by a light-fixing type heat-sensitive color print system, Pictorography 3000 of a laser exposure heat development transfer system, or a film recorder. Further, in accordance with Aladdin 1000, digital data can be outputted directly on a floppy disc or a Zip disc, or on CD-R through a CD writer.

On the other hand, in home, only by loading a developed AP system cartridge film on photo player AP-1 (manufactured by Fuji Photo Film Co., Ltd.), the photographs can be seen on TV, and when the cartridge is loaded on a photo scanner AS-1, the image data can be continuously taken into a personal computer at high speed. For inputting films, prints and three dimensional objects, photo-vision FV-10/FV-5 (manufactured by Fuji Photo Film Co., Ltd.) can be used. The image data recorded on a floppy disc, a Zip disc, a CD-R or a hard disc can be processed variously on a personal computer by utilizing Application Soft Photo Factory of Fuji Photo Film Co., Ltd. For outputting a high quality printed matter from a computer, a digital color printer, NC-2/NC-2D (manufactured by Fuji Photo Film Co., Ltd.) by a light-fixing type heat-sensitive color print system can be preferably used.

For encasing a developed AP system cartridge film, Fuji Color Pocket Album AP-5 Pop L, AP-1 Pop L, AP-1 Pop KG and Cartridge File 16 are preferably used.

EXAMPLE

The present invention is specifically described below with referring to examples, but it should not be construed as the present invention is limited thereto.

Example I

Silver halide emulsions Em-A to Em-O were prepared according to the following producing methods.

Preparation of Em-A

An aqueous solution (1,200 ml) containing 1.0 g of low molecular weight gelatin having a molecular weight of 15,000 and 1.0 g of KBr was maintained at temperature of 35° C. and vigorously stirred. An aqueous solution (30 ml) containing 1.9 g of $AgNO_3$ and 30 ml of an aqueous solution containing 1.5 g of KBr and 0.7 g of low molecular weight gelatin having a molecular weight of 15,000 were added to the above solution by a double jet method over 30 seconds to perform nucleation. At this time, the excessive concentration of KBr was maintained constant. KBr (6 g) was added thereto, the temperature was raised to 75° C. and the solution was subjected to ripening. After termination of ripening, 35 g of succinated gelatin was added to the above emulsion. The pH was adjusted to 5.5. An aqueous solution (150 ml) containing 30 g of $AgNO_3$ and an aqueous solution containing KBr were added to the above emulsion by a double jet method over 16 minutes. At this time, the silver potential was maintained at −25 mV to the saturated calomel electrode. Further, an aqueous solution containing 110 g of AgNO3 and an aqueous solution containing KBr were added to the above emulsion by a double jet method over 15 minutes with accelerating the flow velocity so that the final flow velocity became 1.2 times the initial flow velocity. At this time, an AgI fine grain emulsion having a grain size of 0.03 μm was added at the same time so that the silver iodide content came to 3.8% with accelerated flow velocity and the silver potential was maintained at −25 mV. An aqueous solution (132 ml) containing 35 g of $AgNO_3$ and an aqueous solution containing KBr were added to the above emulsion by a double jet method over 7 minutes. The addition of the aqueous solution of KBr was adjusted so that the silver potential at addition termination time became −20 mV. The temperature was lowered to 40° C., 5.6 g of Compound 1 in terms of KI was added, further 64 ml of an aqueous solution containing 0.8 M sodium sulfite was added. An aqueous solution containing NaOH was added thereto to adjust pH 9.0 and maintained this pH value for 4 minutes, and after forming iodide ion abruptly, the pH was returned to 5.5. After the temperature was increased to 55° C., 1 mg of sodium benzenethiosulfonate was added, and 13 g of lime-processed gelatin having calcium concentration of 1 ppm was further added. After termination of the addition, 250 ml of an aqueous solution containing 70 g of $AgNO_3$ and an aqueous solution containing KBr were added to the emulsion with maintaining the potential at 60 mV over 20 minutes. Yellow prussiate of potash was added at this time to the emulsion in an amount of $1.0\times10^{-5}$ mol per mol of the silver. After the emulsion was washed with water, 80 g of lime-processed gelatin having calcium concentration of 1 ppm was further added to the emulsion and pH was adjusted to 5.8 and pAg was adjusted to 8.7 at 40° C.

Compound 1

Compound 1

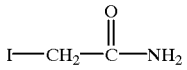

The above emulsion contained 15 ppm of calcium, 2 ppm of magnesium and 1 ppm of strontium on the measurement by ICP emission spectroanalysis. The temperature of the above emulsion was raised to 56° C. In the first place, 1 g in terms of Ag of pure AgBr fine grain emulsion having a grain size of 0.05 μm was added to the emulsion to form shell. In the next place, the solid fine particle dispersions of Sensitizing Dyes 1, 2 and 3 were added to the emulsion in the form of solid fine particle dispersions in an amount of $5.85\times10^{-4}$ mol, $3.06\times10^{-4}$ mol, and $9.00\times10^{-6}$ mol, respectively, each per mol of the silver. The solid fine particle dispersions of Sensitizing Dyes 1, 2 and 3 were prepared as follows. As shown in Table 1, inorganic salts were dissolved in ion exchange water, and then each sensitizing dye was added and dispersed by dissolver blades at 2,000 rpm for 20 minutes at 60° C., thus each of the solid fine particle dispersions of Sensitizing Dyes 1, 2 and 3 were obtained. The sensitizing dyes were added to the above emulsion, and when the adsorption amounts reached 90% of the adsorption amounts under equilibrium condition, calcium nitrate was added so as to reach the calcium concentration of 250 ppm. The adsorption amounts of the sensitizing dyes were obtained by separating a solid layer and a liquid layer by centrifugal precipitation, and measuring the difference between the amount of the sensitizing dyes initially added and the amount of the sensitizing dyes in the supernatant. After the addition of calcium nitrate, potassium thiocyanate, chloroauric acid, sodium thiosulfate, and diphenyl(pentafluorophenyl)phosphineselenide and Compound 4 were added to the emulsion and optimally chemically sensitized. Diphenyl(pentafluorophenyl) phosphineselenide was added in an amount of $3.40\times10^{-6}$ mol per mol of the silver. Compound 2 and Compound 3 were added at chemical sensitization termination, thus Emulsion Em-A was prepared.

TABLE 1

| Sensitizing Dye | Amount of Sensitizing Dye (weight part) | $NaNO_3$/ $Na_2SO_4$ (weight part) | Water (weight part) | Dispersion Time (minute) | Dispersion Temperature (° C.) |
|---|---|---|---|---|---|
| 1 | 3 | 0.8/3.2 | 43 | 20 | 60 |
| 2/3 | 4/0.12 | 0.6/2.4 | 42.8 | 20 | 60 |

Sensitizing Dye 1

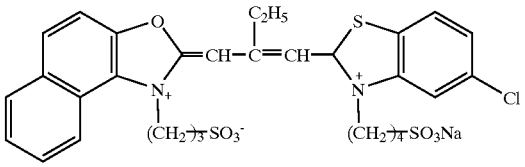

Sensitizing Dye 2

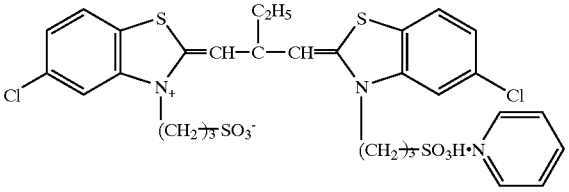

Sensitizing Dye 3

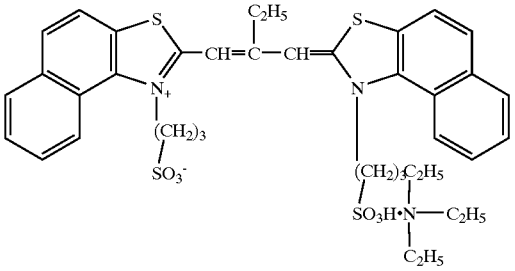

Compound 2

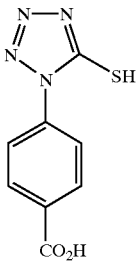

-continued

Compound 3

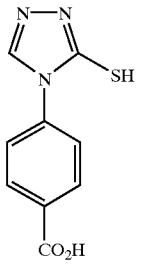

Compound 4

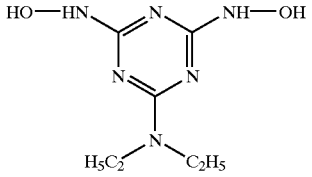

Preparation of Em-B

Em-B was prepared in the same manner as in the preparation of Em-A except that the amount of KBr added after nucleation was changed to 5 g, the succinated gelatin was replaced with trimellited gelatin (trimellited rate: 98%) containing 35 $\mu$mol of methionine per 1 g of the gelatin and having a molecular weight of 100,000, Compound 1 was replaced with Compound 6, the addition amount of Compound 6 was changed to 8.0 g in terms of KI, the amounts of Sensitizing Dyes 1, 2 and 3 added before chemical sensitization were changed to $6.50\times10^{-4}$ mol, $3.40\times10-^{4}$ mol, and $1.00\times10^{-5}$ mol, respectively, and the amount of diphenyl(pentafluorophenyl)phosphineselenide added at chemical sensitization was changed to $4.00\times10^{-6}$ mol.

Compound 6

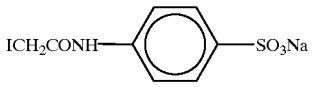

Preparation of Em-C

Em-C was prepared in the same manner as in the preparation of Em-A except that the amount of KBr added after nucleation was changed to 1.5 g, the succinated gelatin was replaced with phthalated gelatin (phthalated rate: 97%) containing 35 $\mu$mol of methionine per 1 g of the gelatin and having a molecular weight of 100,000, Compound 1 was replaced with Compound 7, the addition amount of Compound 7 was changed to 7.1 g in terms of KI, the amounts of Sensitizing Dyes 1, 2 and 3 added before chemical sensitization were changed to $7.80\times10^{-4}$ mol, $4.08\times10^{-4}$ mol, and $1.20\times10^{-5}$ mol, respectively, and the amount of diphenyl(pentafluorophenyl)phosphineselenide added at chemical sensitization was changed to $5.00\times10^{-6}$ mol.

Compound 7

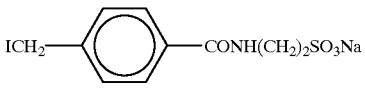

Preparation of Em-E

An aqueous solution (1,200 ml) containing 1.0 g of low molecular weight gelatin having a molecular weight of 15,000 and 1.0 g of KBr was maintained at temperature of 35° C. and vigorously stirred. An aqueous solution (30 ml) containing 1.9 g of $AgNO_3$ and 30 ml of an aqueous solution containing 1.5 g of KBr and 0.7 g of low molecular weight gelatin having a molecular weight of 15,000 were added to the above solution by a double jet method over 30 seconds to perform nucleation. At this time, the excessive concentration of KBr was maintained constant. KBr (6 g) was added thereto, the temperature was raised to 75° C. and the solution was subjected to ripening. After termination of ripening, 15 g of succinated gelatin and 20 g of the above-described trimellited gelatin were added to the above emulsion. The pH was adjusted to 5.5. An aqueous solution (150 ml) containing 30 g of $AgNO_3$ and an aqueous solution containing KBr were added to the above emulsion by a double jet method over 16 minutes. At this time, the silver potential was maintained at −25 mV to the saturated calomel electrode. Further, an aqueous solution containing 110 g of $AgNO_3$ and an aqueous solution containing KBr were added to the above emulsion by a double jet method over 15 minutes with accelerating the flow velocity so that the final flow velocity became 1.2 times the initial flow velocity. At this time, an AgI fine grain emulsion having a grain size of 0.03 $\mu$m was added at the same time so that the silver iodide content came to 3.8% with accelerated flow velocity and the silver potential was maintained at −25 mV. An aqueous solution (132 ml) containing 35 g of $AgNO_3$ and an aqueous solution containing KBr were added to the above emulsion by a double jet method over 7 minutes. The addition of the aqueous solution of KBr was adjusted so that the silver potential at addition termination time became −20 mV. KBr was added to the emulsion to adjust the potential to −60 mV, then 1 mg of sodium benzenethiosulfonate was added, and 13 g of lime-processed gelatin having calcium concentration of 1 ppm was further added. After termination of the addition of the gelatin, 250 ml of an aqueous solution containing 70 g of $AgNO_3$ and an aqueous solution containing KBr were added to the emulsion with maintaining the potential at −60 mV over 20 minutes, while continuously adding 8.0 g (in terms of KI) of an AgI fine grain emulsion having a grain size of 0.008 $\mu$m (equivalent-sphere diameter), which fine grain emulsion was prepared immediately before addition by mixing an aqueous solution containing low molecular weight gelatin having a molecular weight of 15,000, an aqueous solution containing $AgNO_3$, and an aqueous solution containing KI in a chamber equipped with a magnetic coupling induction stirrer as disclosed in JP-A-10-43570. Yellow prussiate of potash was added at this time to the emulsion in an amount of $1.0\times10^{-5}$ mol per mol of the silver. After the emulsion was washed with water, 80 g of lime-processed gelatin having calcium concentration of 1 ppm was further added to the emulsion and pH was adjusted to 5.8 and pAg was adjusted to 8.7 at 40° C.

The above emulsion contained 15 ppm of calcium, 2 ppm of magnesium and 1 ppm of strontium on the measurement by ICP emission spectroanalysis. Chemical sensitization was performed in the same manner as in the preparation of Em-A except that Sensitizing Dyes 1, 2 and 3 were replaced with Sensitizing Dyes 4, 5 and 6 and the addition amounts were changed to $7.73\times10^{-4}$ mol, $1.65\times10^{-4}$ mol, and $6.20\times10^{-5}$ mol, respectively. Thus, Emulsion Em-E was prepared.

Sensitizing Dye 4

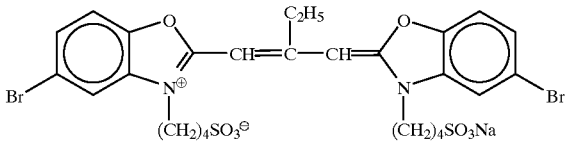

Sensitizing Dye 5

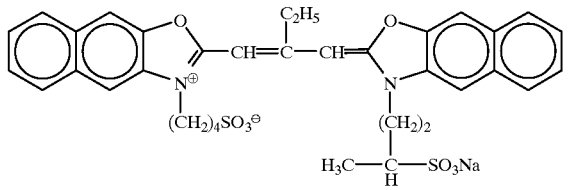

Sensitizing Dye 6

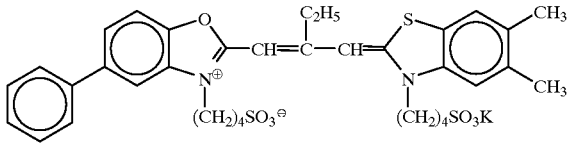

Preparation of Em-F

An aqueous solution (1,200 ml) containing 1.0 g of low molecular weight gelatin having a molecular weight of 15,000 and 1.0 g of KBr was maintained at temperature of 35° C. and vigorously stirred. An aqueous solution (30 ml) containing 1.9 g of $AgNO_3$ and 30 ml of an aqueous solution containing 1.5 g of KBr and 0.7 g of low molecular weight gelatin having a molecular weight of 15,000 were added to the above solution by a double jet method over 30 seconds to perform nucleation. At this time, the excessive concentration of KBr was maintained constant. KBr (5 g) was added thereto, the temperature was raised to 75° C. and the solution was subjected to ripening. After termination of ripening, 20 g of succinated gelatin and 15 g of phthalated gelatin were added to the above emulsion. The pH was adjusted to 5.5. An aqueous solution (150 ml) containing 30 g of $AgNO_3$ and an aqueous solution containing KBr were added to the above emulsion by a double jet method over 16 minutes. At this time, the silver potential was maintained at −25 mV to the saturated calomel electrode. Further, an aqueous solution containing 110 g of $AgNO_3$ and an aqueous solution containing KBr were added to the above emulsion by a double jet method over 15 minutes with accelerating the flow velocity so that the final flow velocity became 1.2 times the initial flow velocity. At this time, an AgI fine grain emulsion having a grain size of 0.03 $\mu$m was added at the same time so that the silver iodide content came to 3.8% with accelerated flow velocity and the silver potential was maintained at −25 mV. An aqueous solution (132 ml) containing 35 g of $AgNO_3$ and an aqueous solution containing KBr were added to the above emulsion by a double jet method over 7 minutes. After the potential was adjusted to −60 mV by the addition of the aqueous solution of KBr, 9.2 g (in terms of KI) of an AgI fine grain emulsion having a grain size of 0.03 Mm was added. Sodium benzenethiosulfonate (1 mg) was added, and 13 g of lime-processed gelatin having calcium concentration of 1 ppm was further added. After termination of the addition, 250 ml of an aqueous solution containing 70 g of $AgNO_3$ and an aqueous solution containing KBr were added to the emulsion with maintaining the potential at 60 mV over 20 minutes. Yellow prussiate of potash was added at this time to the emulsion in an amount of $1.0\times10^{-5}$ mol per mol of the silver. After the emulsion was washed with water, 80 g of lime-processed gelatin having calcium concentration of 1 ppm was further added to the emulsion and pH was adjusted to 5.8 and pAg was adjusted to 8.7 at 40° C.

The above emulsion contained 15 ppm of calcium, 2 ppm of magnesium and 1 ppm of strontium on the measurement by ICP emission spectroanalysis. Chemical sensitization was performed in the same manner as in the preparation of Em-B except that Sensitizing Dyes 1, 2 and 3 were replaced with Sensitizing Dyes 4, 5 and 6 and the addition amounts were changed to $8.50\times10^{-4}$ mol, $1.82\times10^{-4}$ mol, and $6.82\times10^{-5}$ mol, respectively. Thus, Emulsion Em-F was prepared.

Preparation of Em-G

An aqueous solution (1,200 ml) containing 1.0 g of low molecular weight gelatin having a molecular weight of 15,000 and 1.0 g of KBr was maintained at temperature of 35° C. and vigorously stirred. An aqueous solution (30 ml) containing 1.9 g of $AgNO_3$ and 30 ml of an aqueous solution containing 1.5 g of KBr and 0.7 g of low molecular weight gelatin having a molecular weight of 15,000 were added to the above solution by a double jet method over 30 seconds to perform nucleation. At this time, the excessive concentration of KBr was maintained constant. KBr (1.5 g) was added thereto, the temperature was raised to 75° C. and the solution was subjected to ripening. After termination of ripening, 15 g of the above-described trimellited gelatin and 20 g of the above-described phthalated gelatin were added to the above emulsion. The pH was adjusted to 5.5. An aqueous solution (150 ml) containing 30 g of $AgNO_3$ and an aqueous solution containing KBr were added to the above emulsion by a double jet method over 16 minutes. At this time, the silver potential was maintained at −25 mV to the saturated calomel electrode. Further, an aqueous solution containing 110 g of $AgNO_3$ and an aqueous solution containing KBr were added to the above emulsion by a double jet method over 15 minutes with accelerating the flow velocity so that the final flow velocity became 1.2 times the initial flow velocity. At this time, an AgI fine grain emulsion having a grain size of 0.03 $\mu$m was added at the same time so that the silver iodide content came to 3.8% with accelerated flow velocity and the silver potential was maintained at −25 mV. An aqueous solution (132 ml) containing 35 g of $AgNO_3$ and an aqueous solution containing KBr were added to the above emulsion by a double jet method over 7 minutes. After the potential was adjusted to −60 mV by the addition of the aqueous solution of KBr, 7.1 g (in terms of KI) of an AgI fine grain emulsion having a grain size of 0.03 $\mu$m was added. Sodium benzenethiosulfonate (1 mg) was added, and 13 g of lime-processed gelatin having calcium concentration of 1 ppm was further added. After termination of the addition, 250 ml of an aqueous solution containing 70 g of $AgNO_3$ and an aqueous solution containing KBr were added to the emulsion with maintaining the potential at 60 mV over 20 minutes. Yellow prussiate of potash was added at this time to the emulsion in an amount of $1.0\times10^{-5}$ mol per mol of the silver. After the emulsion was washed with water, 80 g of lime-processed gelatin having calcium concentration of 1 ppm was further added to the emulsion and pH was adjusted to 5.8 and pAg was adjusted to 8.7 at 40° C.

The above emulsion contained 15 ppm of calcium, 2 ppm of magnesium and 1 ppm of strontium on the measurement by ICP emission spectroanalysis. Chemical sensitization was performed in the same manner as in the preparation of Em-C except that Sensitizing Dyes 1, 2 and 3 were replaced with Sensitizing Dyes 4, 5 and 6 and the addition amounts were changed to $1.00\times10^{-3}$ mol, $2.15\times10^{-4}$ mol. and $8.06\times10^{-5}$ mol, respectively. Thus, Emulsion Em-G was prepared.

Preparation of Em-J

Emulsion Em-J was prepared in the same manner as in the preparation of Em-B except that the sensitizing dyes added before chemical sensitization were changed to Sensitizing Dyes 7 and 8 and the addition amounts were changed to 7. $65\times10^{-4}$ mol and $2.74\times10^{-4}$ mol, respectively.

Sensitizing Dye 7

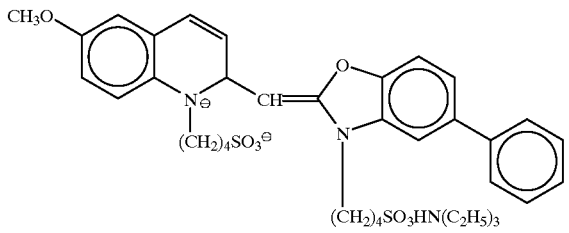

Sensitizing Dye 8

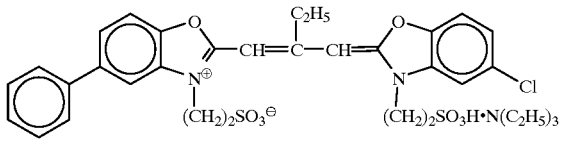

Preparation of Em-L

Preparation of Silver Bromide Seed Crystal Emulsion

A silver bromide tabular emulsion having an average equivalent-sphere diameter of 0. 6 μm, an aspect ratio of 9.0, and containing 1.16 mol of silver per kg of the emulsion and 66 g of gelatin was prepared.

Growing Step 1

Zero point three (0.3) grams of modified silicone oil was added to 1,250 g of an aqueous solution containing 1.2 g of potassium bromide and trimellited gelatin (trimellited rate: 98%). The above-prepared silver bromide tabular emulsion containing 0.086 mol of silver was added to this solution, and the mixture was maintained at 78° C. and stirred. An aqueous solution containing 18.1 g of silver nitrate and the above-described silver iodide fine grains having a grain size of 0.037 μm were added in an amount of 5.4 mol based on the silver. At this time, an aqueous solution containing potassium bromide was added thereto by a double jet method so as to reach pAg of 8.1.

Growing Step 2

After sodium benzenethiosulfonate (2 mg) was added to the above reaction mixture, 0.45 g of disodium 3,5-disulfocatechol and 2.5 mg of thiourea dioxide were further added.

Further, an aqueous solution containing 95.7 g of silver nitrate and an aqueous solution containing potassium bromide were added by a double jet method over 66 minutes at accelerated flow velocity. At this time, the above-described silver iodide fine grains having a grain size of 0.037 μm was added in an amount of 7.0 mol based on the silver. At this time, the amount of the above potassium bromide added by a double jet method was adjusted so as to obtain pAg of 8.1. After the addition was terminated, 2 mg of sodium benzenethiosulfonate was added.

Growing Step 3

An aqueous solution containing 19.5 g of silver nitrate and an aqueous solution containing potassium bromide were added to the above reaction solution by a double jet method over 16 minutes. At this time, the amount of the above aqueous solution of potassium bromide was adjusted so as to obtain pAg of 7.9.

Addition of Sparingly Soluble Silver Halide Emulsion 4

After the pAg of the emulsion containing grains formed in the above Graining step 3 were adjusted to 9.3 by an aqueous solution of potassium bromide, 25 g of the above-described silver iodide fine grains having a grain size of 0.037 μm was abruptly added thereto within 20 seconds.

Formation of Outermost Shell 5

Further, an aqueous solution containing 34.9 g of silver nitrate was added to the above emulsion over 22 minutes.

The thus-obtained emulsion was tabular grain emulsion having an average aspect ratio of 9.8, an average equivalent-sphere diameter of 1.4 μm and an average silver iodide content of 5.5 mol.

Chemical Sensitization

After the emulsion was washed with water, succinated gelatin having succinated rate of 98% and calcium nitrate were added to the above emulsion and pH was adjusted to 5.8 and pAg was adjusted to 8.7 at 40° C. The temperature of the emulsion was raised to 60° C., and a silver bromide fine grain emulsion having a grain size of 0.07 μm was added. After 20 minutes, Sensitizing Dye (102) and Sensitizing Dye 10 were added, and then potassium thiocyanate, chloroauric acid, sodium thiosulfate, diphenyl (pentafluorophenyl)phosphineselenide, and Compound 4 were added, and the emulsion was optimally chemically sensitized. Twenty minutes before the termination of chemical sensitization, Compound 3 was added to the emulsion, and Compound 5 was added when chemical sensitization was terminated. "Optimally chemically sensitized" means that the addition amounts of sensitizing dyes and other compounds are selected from the addition amount range of from $10^{-1}$ mol to $10^{-8}$ mol per Mol of the silver halide so that the sensitivity obtained by exposure for 1/100 sec. becomes maximum sensitivity. Sensitizing Dye (102) and Sensitizing Dye 10 were added each in an amount of $1.8\times10^{-4}$ mol per mol of the silver.

Sensitizing Dye 10

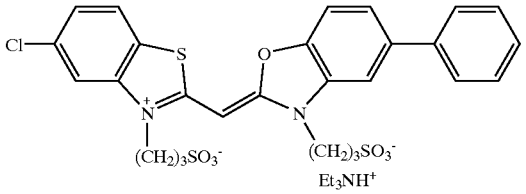

Compound 5

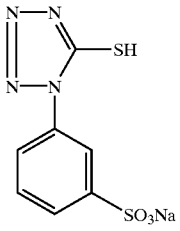

Preparation of Em-O

Into a reaction vessel equipped with a stirrer was put an aqueous solution of gelatin (containing 1,250 ml of distilled water, 48 g of deionized gelatin, and 0.75 g of KBr) and the temperature of the solution was maintained at 70° C. An aqueous solution (276 ml) of $AgNO_3$ (containing 12. 0 g $AgNO_3$) and an aqueous solution of KBr having the equimolar concentration were added to the reaction vessel by a con trolled double jet method over 7 minutes while maintaining pAg at 7.26. Th e temperature of the reaction mixture was lowered to 68° C., and 75 6 ml of thiourea dioxide (0.05 wt %) was added thereto.

Subsequently, 592.9 ml of an aqueous solution of $AgNO_3$ (containing 108.0 g $AgNO_3$) and a mixed aqueous solution containing KBr having the equimolar concentration and KI (KI: 2.0 mol %) were added to the reaction vessel by a controlled double jet method over 18 minutes and 30 seconds while maintaining pAg at 7.30. Five minutes before the termination of addition, 18.0 ml of thiosulfonic acid (0.1 wt %) was added.

The thus-obtained grains were cubic grains having an equivalent-sphere diameter of 0.19 μm and an average silver iodide content of 1.8 mol %.

Em-O was subjected to desalting and washing by an ordinary flocculation method to be re-dispersed, and then pH was adjusted to 6.2 and pAg was adjusted to 7.6 at 40° C.

Em-O was subjected to spectral sensitization and chemical sensitization as described below.

In the first place, Sensitizing Dye 10 and Sensitizing Dye (107) each in an amount of $5.05\times10^{-4}$ mol/mol of Ag, KBr in an amount of $8.82\times10^{-4}$ mol/mol of Ag, sodium thiosulfate in an amount of $9\times10^{-5}$ mol/mol of Ag, an aqueous solution of potassium thiocyanate in an amount of $5.95\times10^{-4}$ mol/mol of Ag, potassium chloroaurate in an amount of $3.22\times10^{-5}$ mol/mol of Ag, and diphenyl(pentafluorophenyl) phosphineselenide in an amount of $8.8\times10^{-5}$ mol/mol of Ag were added to Em-O and ripening was performed at 68° C. The time of ripening was adjusted so that the sensitivity obtained by exposure for 1/100 sec. becomes maximum sensitivity.

Em-D, H, I, K, M and N

In the preparation of each of Em-D, H, I, K, M and N, low molecular gelatin was used in accordance with the example in JP-A-1-158426. Each emulsion was subjected to gold sensitization, sulfur sensitization and selenium sensitization in the presence of the spectral sensitizing dye shown in Table 2 below and potassium thiocyanate in accordance with the example in JP-A-3-237450. Each of Emulsions Em-D, H, I and K contained Ir and Fe in an optimal amount. Em-M and N were subjected to reduction sensitization during grain formation with thiourea dioxide and thiosulfonic acid in accordance with the example in JP-A-2-191938.

TABLE 2

| Name of Emulsion | Sensitizing Dye | Amount Added (mol/mol Ag) |
|---|---|---|
| Em-D | Sensitizing Dye 1 | $5.44\times10^{-4}$ |
| | Sensitizing Dye 2 | $2.35\times10^{-4}$ |
| | Sensitizing Dye 3 | $7.26\times10^{-6}$ |
| Em-H | Sensitizing Dye 8 | $6.52\times10^{-4}$ |
| | Sensitizing Dye 13 | $1.35\times10^{-4}$ |
| | Sensitizing Dye 6 | $2.48\times10^{-5}$ |
| Em-I | Sensitizing Dye 8 | $6.09\times10^{-4}$ |
| | Sensitizing Dye 13 | $1.26\times10^{-4}$ |
| | Sensitizing Dye 6 | $2.32\times10^{-5}$ |
| Em-K | Sensitizing Dye 7 | $6.27\times10^{-4}$ |
| | Sensitizing Dye 8 | $2.24\times10^{-4}$ |
| Em-M | Sensitizing Dye (102) | $3.64\times10^{-4}$ |
| | Sensitizing Dye 10 | $3.64\times10^{-4}$ |
| Em-N | Sensitizing Dye (102) | $4.92\times10^{-4}$ |
| | Sensitizing Dye 10 | $4.92\times10^{-4}$ |

Sensitizing Dye 13

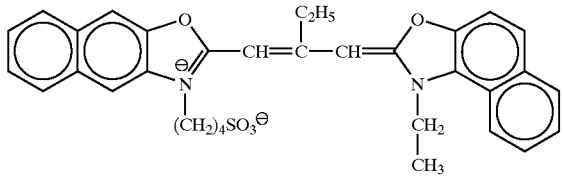

TABLE 3

| Emulsion Name | Average Iodide Content (mol %) | Equivalent-Sphere Diameter (μm) | Aspect Ratio | Equivalent-Circle Diameter (μm) | Grain Thickness (μm) | Shape Of Grains |
|---|---|---|---|---|---|---|
| A | 4 | 0.92 | 14 | 2 | 0.14 | Tabular |
| B | 5 | 0.8 | 12 | 1.6 | 0.13 | tabular |
| C | 4.7 | 0.51 | 7 | 0.85 | 0.12 | tabular |
| D | 3.9 | 0.37 | 2.7 | 0.4 | 0.15 | tabular |
| E | 5 | 0.92 | 14 | 2 | 0.14 | tabular |
| F | 5.5 | 0.8 | 12 | 1.6 | 0.13 | tabular |
| G | 4.7 | 0.51 | 7 | 0.85 | 0.12 | tabular |
| H | 3.7 | 0.49 | 3.2 | 0.58 | 0.18 | tabular |
| I | 2.8 | 0.29 | 1.2 | 0.27 | 0.23 | tabular |
| J | 5 | 0.8 | 12 | 1.6 | 0.13 | tabular |
| K | 3.7 | 0.47 | 3 | 0.53 | 0.18 | tabular |
| L | 5.5 | 1.4 | 9.8 | 2.6 | 0.27 | tabular |
| M | 8.8 | 0.64 | 5.2 | 0.85 | 0.16 | tabular |
| N | 3.7 | 0.37 | 4.6 | 0.55 | 0.12 | tabular |
| O | 1.8 | 0.19 | — | — | — | cubic |

In Table 3, the dislocation lines as disclosed in JP-A-3-237450 were observed with tabular grains with a high pressure electron microscope.

1) Support

The support used in the present invention was prepared as follows.

1) First Layer and Subbing Layer

Both surfaces of a polyethylene naphthalate support having a thickness of 90 p were subjected to glow discharge treatment at treatment atmospheric pressure of 26.7 pascal, $H_2O$ partial pressure in the atmospheric gas of 75%, discharge frequency of 30 kHz, output of 2,500 W, and treatment intensity of 0.5 kV·A·min/m$^2$. As the first layer, a coating solution having the composition shown below was coated on the support in a coating amount of 5 ml/m by the bar coating method disclosed in JP-B-58-4589.

| | |
|---|---|
| Electrically conductive fine particle dispersion solution (water dispersion solution of $SnO_2/Sb_2O_5$ of particle concentration of 10%, primary particle size: 0.005 μm, average particle size of secondary agglomerate: 0.05 μm) | 50 weight parts |
| Gelatin | 0.5 weight parts |
| Water | 49 weight parts |
| Polyglcerol polyglycidyl ether | 0.16 weight parts |
| Polyoxyethylene sorbitan monolaurate (degree of polymerization: 20) | 0.1 weight parts |

After the first layer was coated, the support was wound around a stainless steel core having a diameter of 20 cm and heat-treated at 110° C. (Tg of PEN support: 119° C.) for 48 hours to give the support heat hysteresis. After the annealing treatment, a subbing layer for an emulsion having the composition shown below was coated on the side of the support opposite to the side on which the first layer was coated in a coating amount of 10 ml/m$^2$ by a bar coating method.

| | |
|---|---|
| Gelatin | 1.01 weight parts |
| Salicylic acid | 0.30 weight parts |
| Resorcine | 0.40 weight parts |
| Polyoxyethylene nonylphenyl ether (degree of polymerization: 10) | 0.11 weight parts |
| Water | 3.53 weight parts |
| Methanol | 84.57 weight parts |
| n-Propanol | 10.08 weight parts |

Further, the second layer and the third layer described later were coated on the first layer in order, and a color negative photographic material having the composition described later was multilayer-coated on the opposite side, thus a transparent magnetic recording medium having a silver halide emulsion layer was obtained.

2) Second Layer (Transparent Magnetic Recording Layer)

Dispersion of Magnetic Substance

To a vessel were added 1,100 weight parts of Co-adhered $\gamma$-$Fe_2O_3$ magnetic substance (average long axis length: 0.25 $\mu$m, $S_{BET}$: 39 $m^2/g$, Hc: 831 Oe, $\sigma s$: 77.1 emu/g, ar: 37.4 emu/g), 220 weight parts of water, and 165 weight parts of a silane coupling agent [3-(polyoxyethynyl)oxypropyl trimethoxysilane, degree of polymerization: 10] and the contents of the vessel were thoroughly kneaded by means of an open kneader for 3 hours. This coarsely dispersed viscous solution was dried at 70° C. for a whole day and night to remove water, and then heat-treated at 110° C. for 1 hour, thus the surface-treated magnetic particles were prepared.

Kneading was performed again by the following prescription with an open kneader for 4 hours.

| | |
|---|---|
| The above-obtained surface treated magnetic particles | 855 g |
| Diacetyl cellulose | 25.3 g |
| Methyl ethyl ketone | 136.3 g |
| Cyclohexanone | 136.3 g |

Further, fine dispersion was performed by the following prescription with a sand mill (sand mill: ¼ G) at 2,000 rpm for 4 hours. Glass beads of 1 $\phi$ mm were used as the dispersing media.

| | |
|---|---|
| The above-kneaded solution | 45 g |
| Diacetyl cellulose | 23.7 g |
| Methyl ethyl ketone | 127.7 g |
| Cyclohexanone | 127.7 g |

An intermediate solution containing the magnetic substance was prepared by the following prescription.

Preparation of Intermediate Solution Containing Magnetic Substance

| | |
|---|---|
| Fine dispersion solution of the above magnetic substance | 674 g |
| Diacetyl cellulose solution (solid content: 4.34%, solvent: a 1/1 mixture of methyl ethyl ketone/cyclohexanone) | 24,280 g |
| Cyclohexanone | 46 g |

These components were mixed and stirred with a disper to prepare an intermediate solution containing a magnetic substance.

A dispersion solution of an $\alpha$-alumina abrasive of the present invention was prepared by the following prescription.

(a) Sumicorundum AA-1.5 (average primary particle: 1.5 $\mu$m, specific surface area: 1.3 $m^2/g$)

Preparation of Dispersion Solution of Particles

| | |
|---|---|
| Sumicorundum AA-1.5 | 152 g |
| Silane coupling agent KBM903 (manufactured by Shin-Etsu Silicone Co., Ltd.) | 0.48 g |
| Diacetyl cellulose solution (solid content: 4.5%, solvent: a 1/1 mixture of methyl ethyl ketone/cyclohexanone) | 227.52 g |

Fine dispersion was performed by the above prescription with a ceramic-coated sand mill (sand mill: ¼ G) at 800 rpm for 4 hours. Zirconia beads of 1 mm $\phi$ were used as the dispersing media.

(b) Colloidal Silica Particle Dispersion Solution (Super-Fine Particles)

MEK-ST manufactured by Nissan Chemical Industries, Ltd. was used.

This was dispersion solution of colloidal silica having an average primary particle size of 0.015 $\mu$m, and methyl ethyl ketone was used as the dispersion medium. The solid content was 30%.

Preparation of Second Layer Coating Solution

| | |
|---|---|
| Intermediate solution containing the above magnetic substance | 19,053 g |
| Diacetyl cellulose solution (solid content: 4.5%, solvent: a 1/1 mixture of methyl ethyl ketone/cyclohexanone) | 264 g |
| Colloidal silica dispersion solution (MEK-ST, dispersion solution (b), solid content: 30%) | 128 g |
| AA-1.5 dispersion solution (dispersion solution (a)) | 12 g |
| Millionate MR-400 dilution solution (manufactured by Nippon Polyurethane Co., Ltd.) (solid content: 20%, solvent for dilution: a 1/1 mixture of methyl ethyl ketone/cyclohexanone) | 203 g |
| Methyl ethyl ketone | 170 g |
| Cyclohexanone | 170 g |

A coating solution obtained by mixing and stirring the above components was coated on the support in a coating amount of 29.3 $ml/m^2$ by a wire bar coating method. Drying was performed at 110° C. The thickness of the magnetic layer after drying was 1.0 $\mu$m.

3) Third Layer (Layer Containing Higher Fatty Acid Ester Sliding Agent)

Preparation of Stock Solution of Sliding Agent Dispersion

Solution (i) shown below was heated at 100° C. and dissolved and added to solution (ii) shown below, and the mixed solution was dispersed with a high pressure homogenizer to thereby obtain a stock solution of sliding agent dispersion.

| Solution (i) | |
|---|---|
| $C_6H_{13}CH(OH)(CH_2)_{10}COOC_{50}H_{101}$ | 399 weight parts |
| $n\text{-}C_{50}H_{101}O(CH_2CH_2O)_{16}H$ | 171 weight parts |
| Cyclohexanone | 830 weight parts |

| Solution (ii) | |
|---|---|
| Cyclohexanone | 8,600 weight parts |

Preparation of Spherical Inorganic Particle Dispersion Solution

The dispersion solution of spherical inorganic particles (c1) was prepared by the following prescription.

| | |
|---|---|
| Isopropyl alcohol | 93.54 weight parts |
| Silane coupling agent KBM903 (manufactured by Shin-Etsu Silicone Co., Ltd.), | |
| Compound 1-1 ($(CH_3O)_3Si—(CH_2)_3—NH_2$) | 5.53 weight parts |
| Compound 2-1 | 2.93 weight parts |

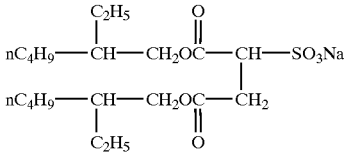

| | |
|---|---|
| Seahostar-KEP50 (amorphous silica, average particle size: 0.5 μm, manufactured by Nippon Shokubai Co., Ltd.) | 88.00 weight parts |
| The above components were stirred for 10 minutes, then the following was further added. | |
| Diacetone alcohol | 252.93 weight parts |

The above mixed solution was dispersed for 3 hours with an ultrasonic homogenizer (SONIFIER 450, manufactured by BRANSON Co., Ltd.) with ice-cooling and stirring. Thus, the dispersion solution of spherical inorganic particles c1 was prepared.

Preparation of Spherical Organic High Polymer Particle Dispersion Solution

The dispersion solution of spherical organic high polymer particles (c2) was prepared by the following prescription.

| | |
|---|---|
| XC99-A8808 (spherical crosslinkable polysiloxane particles, average particle size: 0.9 μm, manufactured by Toshiba Silicone Co., Ltd.) | 60 weight parts |
| Methyl ethyl ketone | 120 weight parts |
| Cyclohexanone (solid content: 20%, solvent: a 1/1 mixture of methyl ethyl ketone/cyclohexanone) | 120 weight parts |

The above solution was dispersed for 2 hours with an ultrasonic homogenizer (SONIFIER 450, manufactured by BRANSON Co., Ltd.) with ice-cooling and stirring. Thus, the dispersion solution of spherical organic high polymer particles c2 was prepared.

Preparation of Third Layer Coating Solution

The following composition was added to 542 g of the above-described stock solution of sliding agent dispersion to thereby prepare a coating solution of the third layer.

| | |
|---|---|
| Diacetone alcohol | 5,950 g |
| Cyclohexanone | 176 g |
| Ethyl acetate | 1,700 g |
| The above dispersion solution of Seahostar-KEP50 (c1) | 53.1 g |
| The above dispersion solution of spherical organic high polymer particles (c2) | 300 g |
| FC431 (solid content: 50%, solvent: ethyl acetate, manufactured by 3M Co., Ltd.) | 2.65 g |
| BYK 310 (solid content: 25%, manufactured by BYK Chemi Japan) | 5.3 g |

The above coating solution of the third layer was coated on the second layer in a coating amount of 10.35 ml/$m^2$ and dried at 110° C., followed by further drying at 97° C. for 3 minutes.

4) Coating of Light-Sensitive Layer

In the next place, each layer having the composition shown below was multilayer coated on the opposite side of the above obtained backing layers and a color negative film was prepared.

Composition of Light-Sensitive Layer

The main components for use in each layer are classified as follows:

ExC: Cyan Coupler

ExM: Magenta Coupler

ExY: Yellow Coupler

UV: Ultraviolet Absorber

HBS: High Boiling Point Organic Solvent

H: Hardening Agent for Gelatin

The numeral corresponding to each component indicates the coated weight in unit of g/$m^2$, and the coated weight of silver halide is shown as the calculated weight of silver.

| First Layer: First Antihalation Layer | |
|---|---|
| Black Colloidal Silver | 0.122 as silver |
| Silver Iodobromide Emulsion Having Particle Size of 0.07 μm | 0.01 as silver |
| Gelatin | 0.919 |
| ExC-1 | 0.002 |
| ExC-3 | 0.002 |
| Cpd-2 | 0.001 |
| HBS-1 | 0.005 |
| HBS-2 | 0.002 |

| Second Layer: Second Antihalation Layer | |
|---|---|
| Black Colloidal Silver | 0.055 as silver |
| Gelatin | 0.425 |
| ExF-1 | 0.002 |
| Solid Dispersion Dye ExF-9 | 0.120 |
| HBS-1 | 0.074 |

| Third Layer: Low-speed Red-Sensitive Emulsion Layer | |
|---|---|
| Em-D | 0.577 as silver |
| Em-C | 0.347 as silver |
| ExC-1 | 0.188 |
| ExC-2 | 0.011 |
| ExC-3 | 0.075 |
| ExC-4 | 0.121 |
| ExC-5 | 0.010 |
| ExC-6 | 0.007 |
| Cpd-2 | 0.025 |
| Cpd-4 | 0.025 |
| Cpd-7 | 0.050 |
| Cpd-8 | 0.050 |
| HBS-1 | 0.114 |
| HBS-5 | 0.038 |
| Gelatin | 1.474 |

| Fourth Layer: Middle-speed Red-Sensitive Emulsion Layer | |
|---|---|
| Em-B | 0.431 as silver |
| Em-C | 0.432 as silver |
| ExC-1 | 0.154 |
| ExC-2 | 0.068 |
| ExC-3 | 0.018 |
| ExC-4 | 0.103 |
| ExC-5 | 0.023 |
| ExC-6 | 0.010 |
| Cpd-2 | 0.036 |
| Cpd-4 | 0.028 |
| Cpd-7 | 0.010 |
| Cpd-8 | 0.010 |
| HBS-1 | 0.129 |
| Gelatin | 1.086 |

| Fifth Layer: High-speed Red-Sensitive Emulsion Layer | |
|---|---|
| Em-A | 1.108 as silver |
| ExC-1 | 0.180 |
| ExC-3 | 0.035 |
| ExC-6 | 0.029 |
| Cpd-2 | 0.064 |
| Cpd-4 | 0.077 |
| Cpd-7 | 0.040 |
| Cpd-8 | 0.040 |
| HBS-1 | 0.329 |
| HBS-2 | 0.120 |
| Gelatin | 1.245 |

| Sixth Layer: Interlayer | |
|---|---|
| Cpd-1 | 0.094 |
| Cpd-9 | 0.369 |
| Solid Dispersion Dye ExF-4 | 0.030 |
| HBS-1 | 0.049 |
| Polyethyl Acrylate Latex | 0.088 |
| Gelatin | 0.886 |

| Seventh Layer: Layer Giving Interlayer Effect to Red-Sensitive Layers | |
|---|---|
| Em-J | 0.293 as silver |
| Em-K | 0.293 as silver |
| Cpd-4 | 0.030 |
| ExM-2 | 0.120 |
| ExM-3 | 0.016 |
| ExY-1 | 0.016 |
| ExY-6 | 0.036 |
| Cpd-6 | 0.011 |
| HBS-1 | 0.090 |
| HBS-3 | 0.003 |
| HBS-5 | 0.030 |
| Gelatin | 0.610 |

| Eighth Layer: Low-speed Green-Sensitive Emulsion Layer | |
|---|---|
| Em-H | 0.329 as silver |
| Em-G | 0.333 as silver |
| Em-I | 0.088 as silver |
| ExM-2 | 0.378 |
| ExM-3 | 0.047 |
| ExY-1 | 0.017 |
| HBS-1 | 0.098 |
| HBS-3 | 0.010 |
| HBS-4 | 0.077 |
| HBS-5 | 0.548 |
| Cpd-5 | 0.010 |
| Gelatin | 1.470 |

| Ninth Layer: Middle-speed Green-Sensitive Emulsion Layer | |
|---|---|
| Em-F | 0.457 as silver |
| ExM-2 | 0.032 |
| ExM-3 | 0.029 |
| ExM-4 | 0.029 |
| ExY-1 | 0.007 |
| ExC-6 | 0.010 |
| HBS-1 | 0.065 |
| HBS-3 | 0.002 |
| HBS-5 | 0.020 |
| Cpd-5 | 0.004 |
| Gelatin | 0.446 |

| Tenth Layer: High-speed Green-Sensitive Emulsion Layer | |
|---|---|
| Em-E | 0.794 as silver |
| ExC-6 | 0.002 |
| ExM-1 | 0.013 |
| ExM-2 | 0.011 |
| ExM-3 | 0.030 |
| ExM-4 | 0.017 |
| ExY-5 | 0.003 |
| Cpd-3 | 0.004 |
| Cpd-4 | 0.007 |
| Cpd-5 | 0.010 |
| HBS-1 | 0.148 |
| HBS-5 | 0.037 |
| Polyethyl Acrylate Latex | 0.099 |
| Gelatin | 0.939 |

| Eleventh Layer: Yellow Filter Layer | |
|---|---|
| Cpd-1 | 0.094 |
| Solid Dispersion Dye ExF-2 | 0.150 |
| Solid Dispersion Dye ExF-5 | 0.010 |
| Oil-Soluble Dye ExF-7 | 0.010 |
| HBS-1 | 0.049 |
| Gelatin | 0.630 |

| Twelfth Layer: Low-speed Blue-Sensitive Emulsion Layer | |
|---|---|
| Em-O | 0.112 as silver |
| Em-M | 0.320 as silver |
| Em-N | 0.240 as silver |
| ExC-1 | 0.027 |
| ExY-1 | 0.027 |
| ExY-2 | 0.890 |
| ExY-6 | 0.120 |
| Cpd-2 | 0.100 |
| Cpd-3 | 0.004 |
| HBS-1 | 0.222 |
| HBS-5 | 0.074 |
| Gelatin | 2.058 |

| Thirteenth Layer: High-speed Blue-Sensitive Emulsion Layer | |
|---|---|
| Em-L | 0.714 as silver |
| ExY-2 | 0.211 |
| Cpd-2 | 0.075 |
| Cpd-3 | 0.001 |
| HBS-1 | 0.071 |
| Gelatin | 0.678 |

| Fourteenth Layer: First Protective Layer | |
|---|---|
| Silver Iodobromide Emulsion Having Particle Size of 0.07 μm | 0.301 as silver |
| UV-1 | 0.211 |
| UV-2 | 0.132 |
| UV-3 | 0.198 |
| UV-4 | 0.026 |
| F-18 | 0.009 |
| S-1 | 0.086 |
| HBS-1 | 0.175 |
| HBS-4 | 0.050 |
| Gelatin | 1.984 |

| Fifteenth Layer: Second Protective Layer | |
|---|---|
| H-1 | 0.400 |
| B-1 (diameter: 1.7 μm) | 0.050 |
| B-2 (diameter: 1.7 μm) | 0.150 |
| B-3 | 0.050 |
| S-1 | 0.200 |
| Gelatin | 0.750 |

Further, W-1 to W-6, B-4 to B-6, F-1 to F-18, lead salt, platinum salt, iridium salt and rhodium salt were appropriately included in each layer to improve storage stability, processing properties, pressure resistance, fungicidal and biocidal properties, antistatic properties and coating properties.

Preparation of Dispersion of Organic Solid Dispersion Dye

ExF-2 used in the eleventh layer was prepared as follows.

| | |
|---|---|
| Wet Cake of ExF-2 (containing 17.6 wt % of water) | 2.800 kg |
| Sodium Octylphenyl Diethoxymethanesulfonate (31 wt % aqueous solution) | 0.376 kg |
| F-15 (a 75 aq. soln.) | 0.011 kg |
| Water | 4.020 kg |
| Total (pH was adjusted to 7.2 with NaOH) | 7.210 kg |

The slurry having the above composition was stirred with a dissolver and coarsely dispersed, and then dispersed with an agitator mill LMK-4 at a peripheral speed of 10 m/s, discharge of 0.6 kg/min, and a packing rate of zirconia beads having a diameter of 0.3 mm of 80% until the absorbance ratio of the dispersion solution became 0.29, thereby a solid fine particle dispersion was obtained. The average particle size of the fine particles of the dye was 0.29 μm.

In the same manner as above, the solid dispersions of ExF-4 and ExF-9 were obtained. The average particle sizes of the fine particles of the dyes were 0.28 μm and 0.49 m, respectively. ExF-5 was dispersed in accordance with the microprecipitation dispersion method disclosed in EP-A-549489. The average particle size of the dispersion of ExF-5 was 0.06 μm.

The compounds used in each layer are shown below.

The "mass ratio" described below has the same meaning as the "weight ratio".

ExC-1

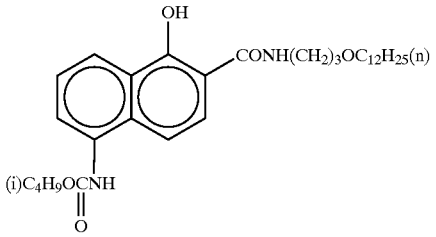

ExC-2

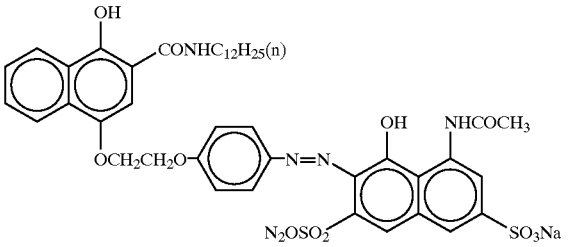

-continued
ExC-3
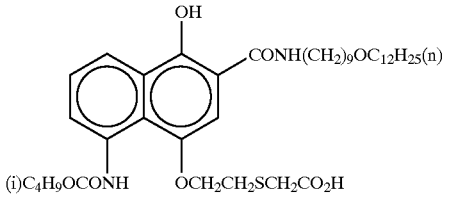
ExC-4
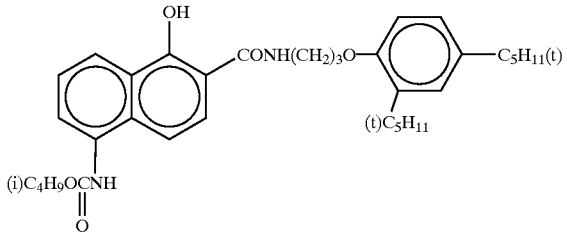
ExC-5
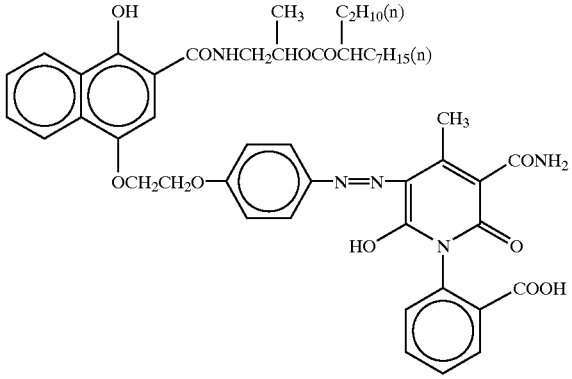
ExC-6
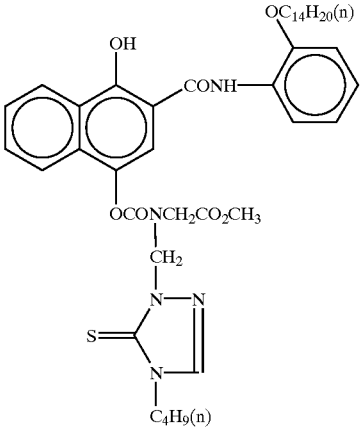
ExM-1
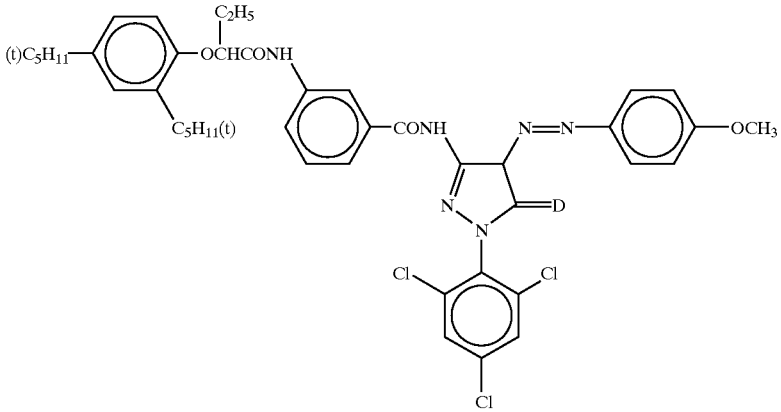
ExM-2
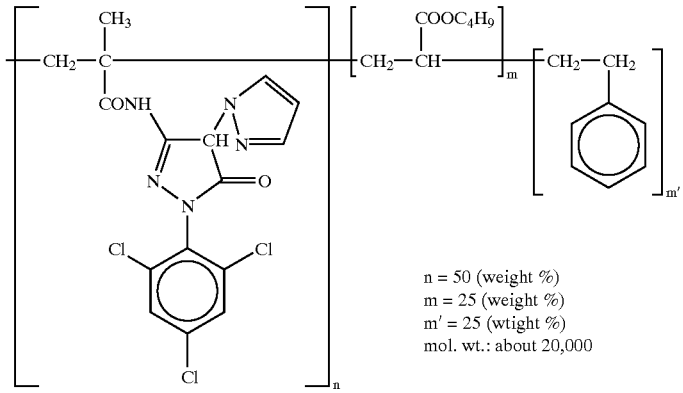
n = 50 (weight %)
m = 25 (weight %)
m′ = 25 (wtight %)
mol. wt.: about 20,000

-continued
ExM-3
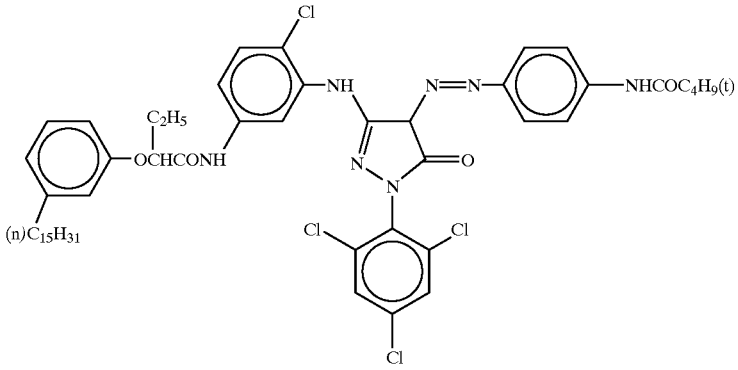
ExM-4
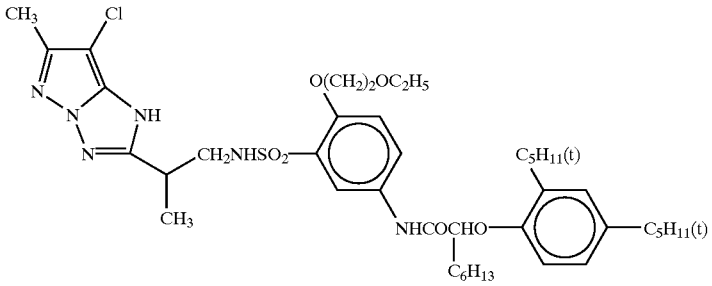
ExY-1
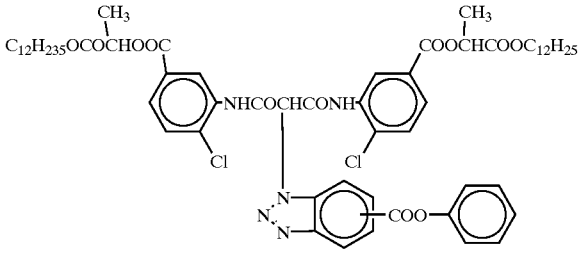
ExY-2
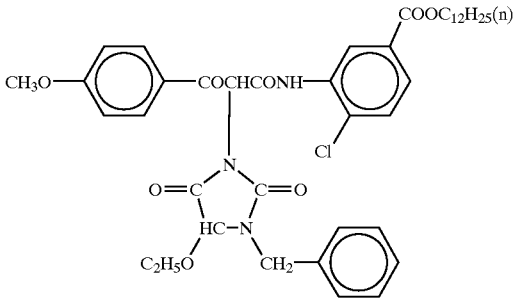
ExY-5
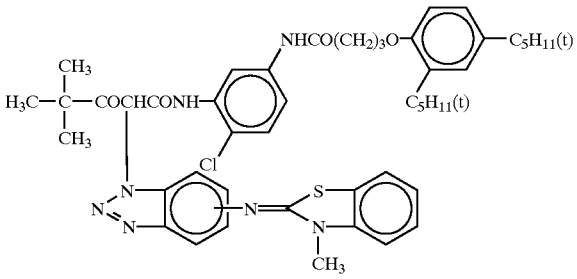
ExY-6
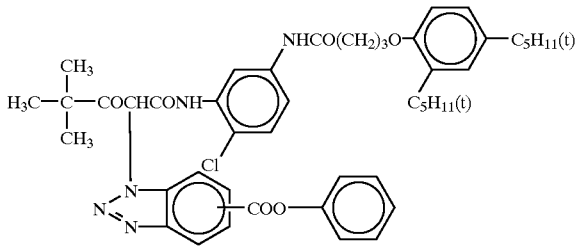
HBS-1
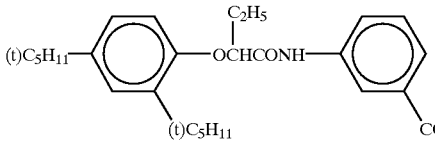
HBS-2
Di-n-butyl Phthalate
Tricresyl Phosphate
HBS-3
HBS-4
Tri (2-ethylhexyl)phosphate -continued
Cpd-1
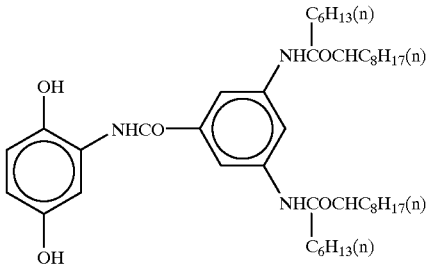
Cpd-2
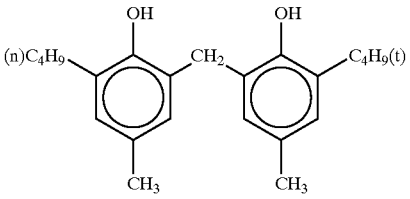
Cpd-3
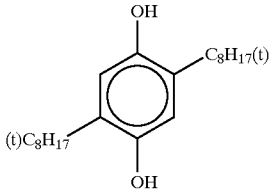
Cpd-4
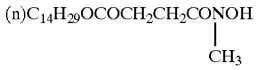
Cpd-5
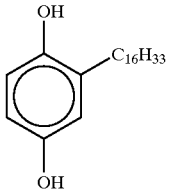
UV-1
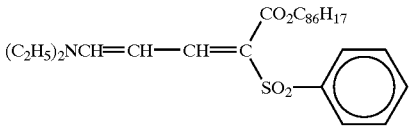
UV-2
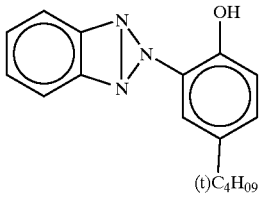
UV-3
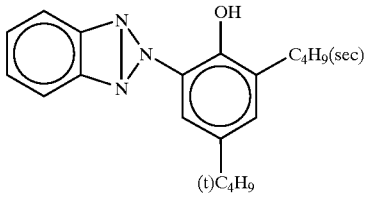
UV-4
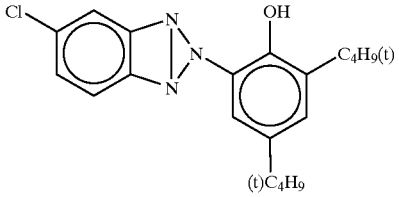
F-1
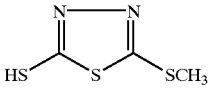
F-2
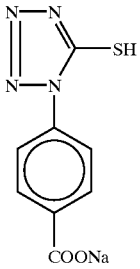
F-3
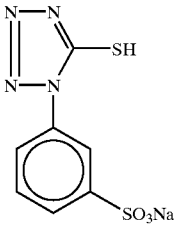
F-4
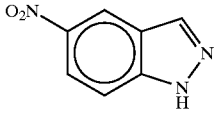
F-5
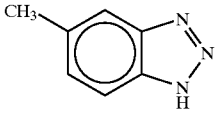

-continued
F-6
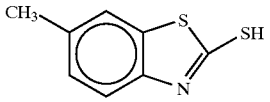
F-7
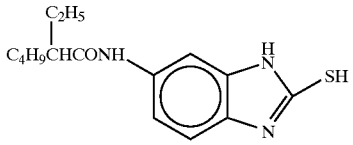
F-8
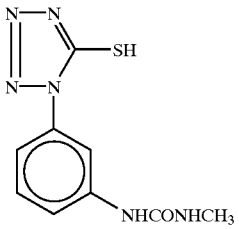
F-9
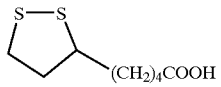
F-10
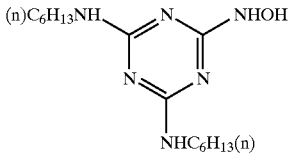
F-11
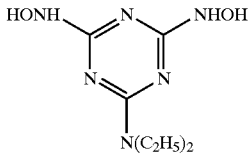
F-12
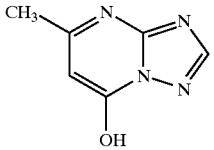
F-13
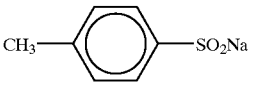
F-14
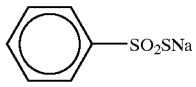
F-15
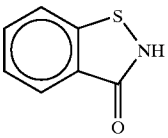
F-16
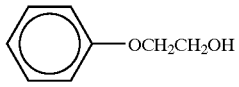
F-17
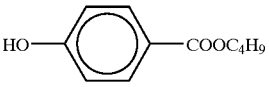
F-18
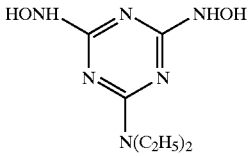
H-1
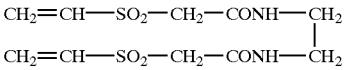
S-1
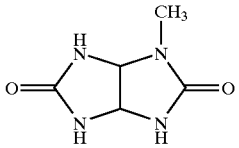
B-1
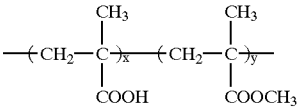
x/y = 10/90 (mass ratio)
average mol. wt. about 35,000
B-2
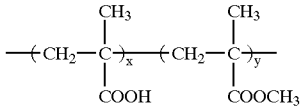
x/y = 40/60 (mass ratio)
average mol. wt. about 20,000
B-3
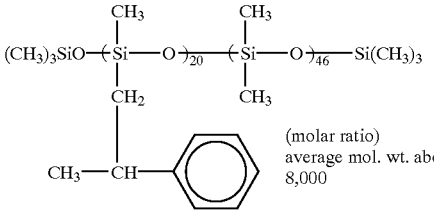
(molar ratio)
average mol. wt. about
8,000

-continued
B-4
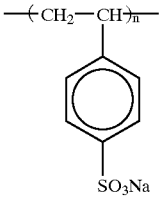
average mol. wt. about 75,000
B-5
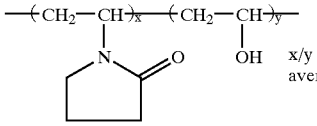
x/y = 70/30 (mass ratio)
average mol. wt. about 17,000
B-6
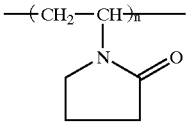
average mol. wt. about 10,000
W-1
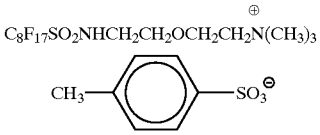
W-2
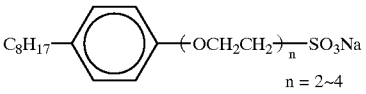
n = 2~4
W-3
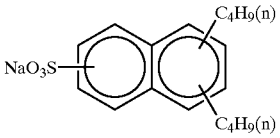
W-4
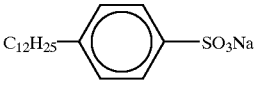
W-5
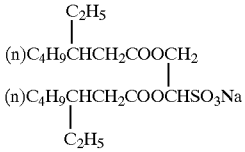
Cpd-6
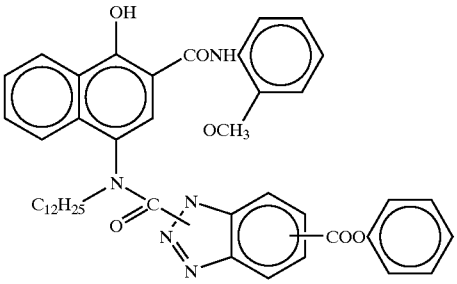
W-6
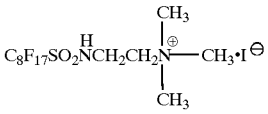
Cpd-7
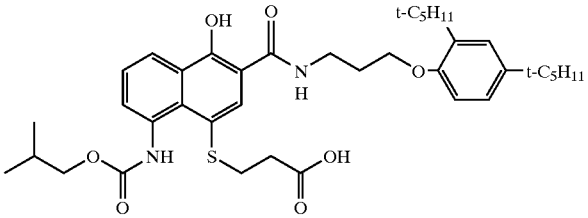
Cpd-8
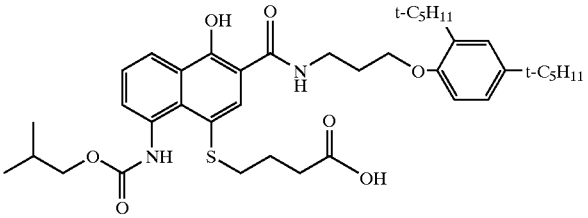
Cpd-9
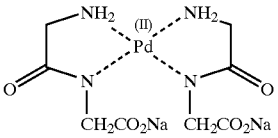
HBS-5
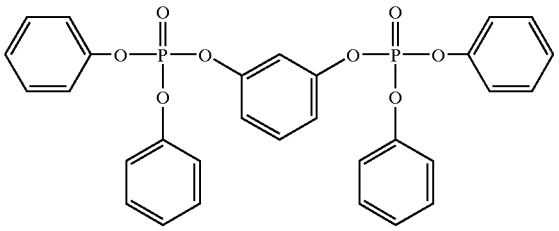

-continued

ExF-1

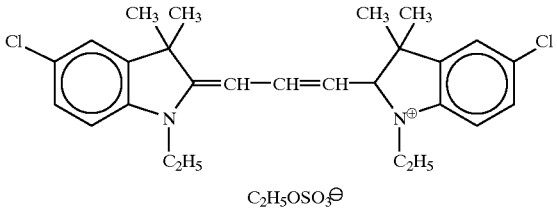

ExF-2

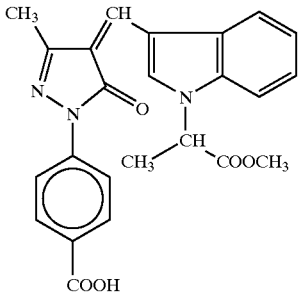

ExF-4

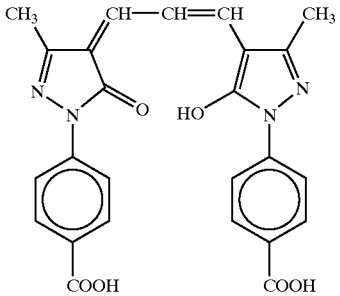

ExF-5

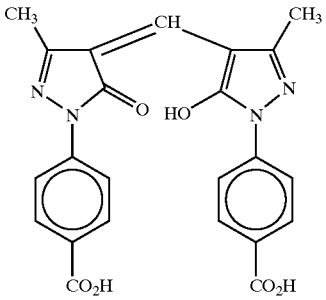

ExF-7

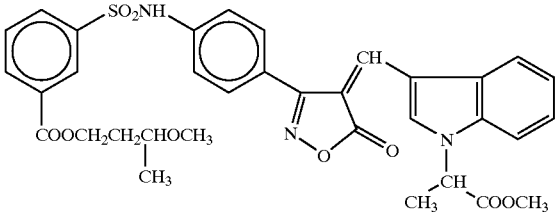

ExF-9

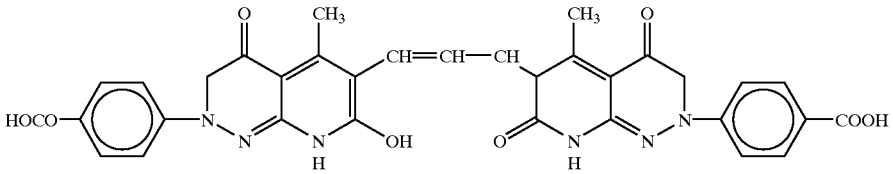

The color negative photographic material prepared above was designated Sample No. 001.

Sample Nos. 002 to 009 were prepared in the same manner as the preparation of Sample No. 001 except that the sensitizing dyes used in the twelfth layer and the thirteenth layer were changed as shown in Table 4 below. The emulsions used in Sample Nos. 010 and 011 were not subjected to reduction sensitization, i.e., in the grain formation of Emulsions O, M, N and L, emulsions to which thiourea dioxide, disodium 3,5-disulfocatechol, and sodium benzenethiosulfate were not added and substantially not reduction sensitized were used.

Each of the obtained samples was subjected to imagewise exposure with white light for 1/100 seconds by continuous wedge, and then subjected to the following color development processing.

The storage stability of each sample was evaluated by allowing the sample to stand at 50° C., 80% RH for 36 hours, and then performing the same imagewise exposure as above and the same color development processing.

Automatic processor FP-360B (manufactured by Fuji Photo Film Co., Ltd.) was used in development. The processor was modified so that the overflow from the bleaching bath was discharged to the waste solution tank not to flow to the after bath. FP-360B processor carried the evaporation compensating means disclosed in Hatsumei Kyokai Kokai Giho No. 94-4992.

TABLE 4

Sensitizing Dyes and Addition Amount in 13th Layer and 14th Layer (mol/mol Ag)

| Sample | 13th Layer | | | 14th Layer | |
|---|---|---|---|---|---|
| No. | Em-K | Em-L | Em-M | Em-N | Remarks |
| 001 | Sensitizing Dye 10 ($5.05 \times 10^{-4}$)<br>Sensitizing Dye (107) ($5.05 \times 10^{-4}$) | Sensitizing Dye 10 ($3.64 \times 10^{-4}$)<br>Sensitizing Dye (102) ($3.64 \times 10^{-4}$) | Sensitizing Dye 10 ($4.92 \times 10^{-4}$)<br>Sensitizing Dye (102) ($4.92 \times 10^{-4}$) | Sensitizing Dye 10 ($1.80 \times 10^{-4}$)<br>Sensitizing Dye (102) ($1.80 \times 10^{-4}$) | Comp. |
| 002 | Sensitizing Dye (4) ($5.05 \times 10^{-4}$)<br>Sensitizing Dye (107) ($5.05 \times 10^{-4}$) | Sensitizing Dye (4) ($3.64 \times 10^{-4}$)<br>Sensitizing Dye (102) ($3.64 \times 10^{-4}$) | Sensitizing Dye (4) ($4.92 \times 10^{-4}$)<br>Sensitizing Dye (102) ($4.92 \times 10^{-4}$) | Sensitizing Dye (4) ($1.80 \times 10^{-4}$)<br>Sensitizing Dye (102) ($1.80 \times 10^{-4}$) | Invention |
| 003 | Sensitizing Dye (5) ($5.05 \times 10^{-4}$)<br>Sensitizing Dye (107) ($5.05 \times 10^{-4}$) | Sensitizing Dye (5) ($3.64 \times 10^{-4}$)<br>Sensitizing Dye (102) ($3.64 \times 10^{-4}$) | Sensitizing Dye (5) ($4.92 \times 10^{-4}$)<br>Sensitizing Dye (102) ($4.92 \times 10^{-4}$) | Sensitizing Dye (5) ($1.80 \times 10^{-4}$)<br>Sensitizing Dye (102) ($1.80 \times 10^{-4}$) | Invention |
| 004 | Sensitizing Dye (6) ($5.05 \times 10^{-4}$)<br>Sensitizing Dye (107) ($5.05 \times 10^{-4}$) | Sensitizing Dye (6) ($3.64 \times 10^{-4}$)<br>Sensitizing Dye (102) ($3.64 \times 10^{-4}$) | Sensitizing Dye (6) ($4.92 \times 10^{-4}$)<br>Sensitizing Dye (102) ($4.92 \times 10^{-4}$) | Sensitizing Dye (6) ($1.80 \times 10^{-4}$)<br>Sensitizing Dye (102) ($1.80 \times 10^{-4}$) | Invention |
| 005 | Sensitizing Dye (8) ($5.05 \times 10^{-4}$)<br>Sensitizing Dye (107) ($5.05 \times 10^{-4}$) | Sensitizing Dye (8) ($3.64 \times 10^{-4}$)<br>Sensitizing Dye (102) ($3.64 \times 10^{-4}$) | Sensitizing Dye (8) ($4.92 \times 10^{-4}$)<br>Sensitizing Dye (102) ($4.92 \times 10^{-4}$) | Sensitizing Dye (8) ($1.80 \times 10^{-4}$)<br>Sensitizing Dye (102) ($1.80 \times 10^{-4}$) | Invention |
| 006 | Sensitizing Dye (9) ($5.05 \times 10^{-4}$)<br>Sensitizing Dye (107) ($5.05 \times 10^{-4}$) | Sensitizing Dye (9) ($3.64 \times 10^{-4}$)<br>Sensitizing Dye (102) ($3.64 \times 10^{-4}$) | Sensitizing Dye (9) ($4.92 \times 10^{-4}$)<br>Sensitizing Dye (102) ($4.92 \times 10^{-4}$) | Sensitizing Dye (9) ($1.80 \times 10^{-4}$)<br>Sensitizing Dye (102) ($1.80 \times 10^{-4}$) | Invention |
| 007 | Sensitizing Dye (2) ($5.05 \times 10^{-4}$)<br>Sensitizing Dye (107) ($5.05 \times 10^{-4}$) | Sensitizing Dye (2) ($3.64 \times 10^{-4}$)<br>Sensitizing Dye (102) ($3.64 \times 10^{-4}$) | Sensitizing Dye (2) ($4.92 \times 10^{-4}$)<br>Sensitizing Dye (102) ($4.92 \times 10^{-4}$) | Sensitizing Dye (2) ($1.80 \times 10^{-4}$)<br>Sensitizing Dye (102) ($1.80 \times 10^{-4}$) | Invention |
| 008 | Sensitizing Dye 10 ($10.1 \times 10^{-4}$) | Sensitizing Dye 10 ($7.28 \times 10^{-4}$) | Sensitizing Dye 10 ($9.84 \times 10^{-4}$) | Sensitizing Dye 10 ($3.60 \times 10^{-4}$) | Comp. |
| 009 | Sensitizing Dye (5) ($10.1 \times 10^{-4}$) | Sensitizing Dye (5) ($7.28 \times 10^{-4}$) | Sensitizing Dye (5) ($9.84 \times 10^{-4}$) | Sensitizing Dye (5) ($3.60 \times 10^{-4}$) | Invention |
| 010 | The same sensitizing dyes were used as in Sample No. 001, however, Emulsions L, N and N were not subjected to reduction sensitization (thiourea dioxide was not used). | | | | Comp. |
| 011 | The same sensitizing dyes were used as in Sample No. 003, however, Emulsions L, N and N were not subjected to reduction sensitization (thiourea dioxide was not used). | | | | Invention |

The processing step and the composition of each processing solution are as follows.

Processing Step

| Step | Processing Time | Processing Temperature (° C.) | Replenishment Rate* (ml) | Tank Capacity (liter) |
|---|---|---|---|---|
| Color Development | 3 min 5 sec | 37.8 | 20 | 11.5 |
| Bleaching | 50 sec | 38.0 | 5 | 5 |
| Fixing (1) | 50 sec | 38.0 | — | 5 |
| Fixing (2) | 50 sec | 38.0 | 8 | 5 |
| Washing | 30 sec | 38.0 | 17 | 3 |
| Stabilization (1) | 20 sec | 38.0 | — | 3 |
| Stabilization (2) | 20 sec | 38.0 | 15 | 3 |
| Drying | 1 min 30 sec | 60.0 | | |

*Replenishment rate: per 1.1 meter of a 35 mm wide photographic material (corresponding to a 24 ex. film)

Stabilization and fixation were conducted in a counter-current system from (2) to (1). All the overflow from the washing bath was introduced to fixing bath (2). Further, the amount of the carryover of the developing solution into the bleaching step, the amount of the carryover of the bleaching solution to the fixing step, and the amount of the carryover of the fixing solution to the washing step were 2.5 ml, 2.0 ml, 2.0 ml respectively per 1.1 meter of 35 mm wide photographic material. Further, the crossover time was 6 seconds in each case, and this time was included in the processing time of the previous step.

The opening area of the above processor is 100 $cm^2$ with the developing solution, 120 $cm^2$ with the bleaching solution and 100 $cm^2$ with other processing solutions.

The composition of each processing solution is described below.

| Color Developing Solution | Tank Solution | Replenisher |
|---|---|---|
| Diethylenetriaminepentaacetic Acid | 3.0 g | 3.0 g |
| Disodium Catechol-3,5-disulfonate | 0.3 g | 0.3 g |
| Sodium Sulfite | 3.9 g | 5.3 g |
| Potassium Carbonate | 39.0 g | 39.0 g |
| Disodium-N,N-bis(2-sulfonatoethyl)-hydroxylamine | 1.5 g | 2.0 g |
| Potassium Bromide | 1.3 g | 0.3 g |
| Potassium Iodide | 1.3 mg | — |
| 4-Hydroxy-6-methyl-1,3,3a,7-tetraazaindene | 0.05 g | — |
| Hydroxylamine Sulfate | 2.4 g | 3.3 g |
| 2-Methyl-4-[N-ethyl-N-(β-hydroxyethyl)amino]aniline | 4.5 g | 6.5 g |

-continued

| Color Developing Solution | Tank Solution | Replenisher |
|---|---|---|
| Sulfate | | |
| Water to make | 1.0 liter | 1.0 liter |
| pH (adjusted with potassium hydroxide and sulfuric acid) | 10.05 | 10.18 |

| Bleaching Solution | Tank Solution (g) | Replenisher (g) |
|---|---|---|
| Ammonium 1,3-Diaminopropanetetra-acetato Ferrate Monohydrate | 113 | 170 |
| Ammonium Bromide | 70 | 105 |
| Ammonium Nitrate | 14 | 21 |
| Succinic Acid | 34 | 51 |
| Maleic Acid | 28 | 42 |
| Water to make | 1.0 liter | 1.0 liter |
| pH (adjusted with aqueous ammonia) | 4.6 | 4.0 |

Fixing (1) Tank Solution

The mixed solution of 5/95 mixture (volume ratio) of the above bleaching tank solution and the following fixing tank solution (pH: 6.8)

| Fixing (2) Tank Solution | Tank Solution (g) | Replenisher (g) |
|---|---|---|
| Aqueous Ammonium Thiosulfate Solution (750 g/liter) | 240 ml | 720 ml |
| Imidazole | 7 | 21 |
| Ammonium Methanethiosulfonate | 5 | 15 |
| Ammonium Methanesulfinate | 10 | 30 |
| Ethylenediaminetetraacetic Acid | 13 | 39 |
| Water to make | 1.0 liter | 1.0 liter |
| pH (adjusted with aqueous ammonia and acetic acid) | 7.4 | 7.45 |

Washing Water

City water was passed through a mixed bed column packed with an H-type strongly acidic cation exchange resin (Amberlite IR-120B of Rohm & Haas) and an OH-type strongly basic anion exchange resin (Amberlite IR-400 of Rohm & Haas) and treated so as to reduce the calcium ion and magnesium ion concentrations to 3 mg/liter or less, subsequently 20 mg/liter of sodium isocyanurate dichloride and 150 mg/liter of sodium sulfate were added thereto. The pH of this washing water was in the range of from 6.5 to 7.5.

| Stabilizing Solution (replenisher equals tank solution) | (unit: g) |
|---|---|
| Sodium p-Toluenesulfinate | 0.03 |
| Polyoxyethylene-p-monononylphenyl Ether (average polymerization degree: 10) | 0.2 |
| Sodium 1,2-Benzisothiazolin-3-one | 0.10 |
| Disodium Ethylenediaminetetraacetate | 0.05 |
| 1,2,4-Triazole | 1.3 |
| 1,4-Bis(1,2,4-triazol-1-yl-methyl)-piperazine | 0.75 |

-continued

| Stabilizing Solution (replenisher equals tank solution) | (unit: g) |
|---|---|
| Water to make | 1.01 |
| pH | 8.5 |

Fog and sensitivity of the processed samples were obtained as follows. Fog was defined by minimum yellow density (Dmin) and sensitivity was a logarithmic value of a reciprocal of exposure amount necessary for giving density of (Dmin of yellow +0.1). The sensitivity was expressed as a relative value e value of Sample No. 001 as the standard.

The results obtained are shown in Table 5 below.

TABLE 5

| Sample | Fresh | | After Storage at 50° C., 80% RH for 36 Hours | | |
|---|---|---|---|---|---|
| No. | Sensitivity | Fog | Sensitivity | Fog | Remarks |
| 001 | 100 (standard) | 0.96 | 70 | 1.10 | Comparison |
| 002 | 105 | 0.96 | 100 | 0.99 | Invention |
| 003 | 106 | 0.96 | 100 | 0.98 | Invention |
| 004 | 104 | 0.96 | 92 | 1.00 | Invention |
| 005 | 102 | 0.96 | 88 | 1.01 | Invention |
| 006 | 103 | 0.96 | 90 | 1.01 | Invention |
| 007 | 101 | 0.96 | 80 | 1.00 | Invention |
| 008 | 85 | 0.97 | 51 | 1.12 | Comparison |
| 009 | 100 | 0.96 | 90 | 1.00 | Invention |
| 010 | 80 | 0.94 | 51 | 1.05 | Comparison |
| 011 | 82 | 0.94 | 82 | 0.94 | Invention |

From the results of Sample Nos. 001 to 009 in Table 5, Sample Nos. 002, 003, 004, 005, 006, 007, 009 in which the dyes of the present invention and the combinations of the dyes of the present invention were used showed higher sensitivity as compared with Sample Nos. 001 and 008. Further, the samples according to the present invention were low in the reduction of sensitivity after storage, thus it can be seen that the increase of fog is conspicuously inhibited.

Of the samples according to the present invention, Sample Nos. 002, 003, 004, 005 and 006 are superior to Sample No.007 in photographic performances, from which it can be seen that the case where at least one of $V^1$ and $V^2$ in formula (I) is an aromatic group or a chlorine atom is preferred. The situation is the same with Sample Nos. 002, 003 and 004 and Sample Nos. 005 and 006, from which it can be seen that the case where at least one of $V^1$ and $V^2$ in formula (I) is an aromatic group and the other is a chlorine atom is particularly preferred.

Further, the same thing can be said from the results of Sample Nos. 010 and 011 in which emulsions were not subjected to reduction sensitization. However, as is seen from the comparison of Sample Nos. 010 and 011 (non-reduction sensitized emulsions) with Sample Nos. 001 and 003 (reduction sensitized emulsions), the sensitizing dyes according to the present invention shows further excellent properties by reduction sensitized emulsions.

It is surprising that the sensitizing dye having a special N-position substituent shows remarkably excellent photographic performances. It is also surprising that the sensitizing dye according to the present invention shows especially excellent photographic performances by the reduction sensitized emulsion.

EFFECT OF THE INVENTION

The present invention can provide a silver halide photographic emulsion which has high sensitivity and is excellent in storage stability and thereby an excellent a silver halide photographic material, by the sensitizing dye of the present invention.

What is claimed is:

1. A silver halide photographic emulsion which comprises at least one methine compound represented by the following formula (I):

(I)

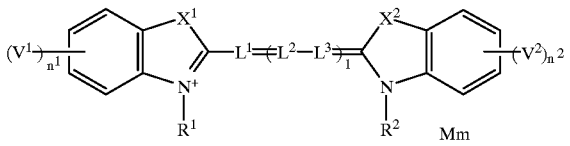

wherein $X^1$ represents a sulfur atom and $X^2$ represents an oxygen atom; one of $V^1$ and $V^2$ represents a chlorine atom and the other represents a phenyl group; $n^1$ and $n^2$ each represents 1; $L^1$, $L^2$ and $L^3$ each represents a methine group; l represents an integer of 0 to 3; M represents a counter ion for balancing electric charge; m represents a necessary number for balancing electric charge; and $R^1$ and $R^2$ each represents an alkyl group represented by any of the following formulae $R_a$, $R_b$, $R_c$, $R_d$ or $R_e$:

$$-(Qa)_r CON^- SO_2 Raa \quad (R_a)$$

$$-(Qb)_s SO_2 N^- COR bb \quad (R_b)$$

$$-(Qc)_t CON^- COR cc \quad (R_c)$$

$$-(Qd)_u SO_2 N^- SO_2 R dd \quad (R_d)$$

$$-(Qe)_v X \quad (R_e)$$

wherein Raa, Rbb, Rcc and Rdd each represents an alkyl group, an aryl group, a heterocyclic group, an alkoxyl group, an aryloxy group, a heterocyclyloxy group, or an amino group; Qa, Qb, Qc, Qd and Qe each represents a divalent linking group; X represents $SO_3^-$, $CO_2^-$, or $PO_3^{2-}$; and r, s, t, u and v each represents an integer of 1 or more, but when X represents $SO_3^-$, v represents 1 or 2.

2. The silver halide photographic emulsion comprising a methine compound as claimed in claim 1, wherein l in formula (I) represents 0.

3. The silver halide photographic emulsion comprising a methine compound as claimed in claim 1, wherein at least either $R^1$ or $R^2$ represents a sulfoethyl group and the other represents Ra, Rb, Rc, Rd or Re wherein Qa, Qb, Qc, Qd and Qe each represents a methylene group.

4. The silver halide photographic emulsion comprising a methine compound as claimed in claim 1, wherein each of $V_1$ and $V_2$ is substituted on the 5-position.

5. The silver halide photographic emulsion comprising a methine compound as claimed in claim 1, wherein said methine compound is represented by the following formula:

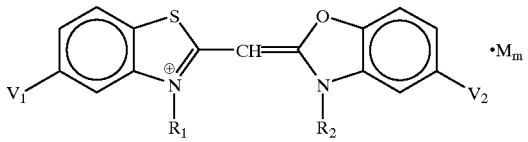

wherein when $V_1$ is Cl, $V_2$ is a phenyl group, or when $V_1$ is a phenyl group, $V_2$ is Cl; when $R_1$ is $(CH_2)_2SO_3$—, $R_2$ is $(CH_2)_3SO_3$—, or when $R_1$ is $(CH_2)_3SO_3$—, $R_2$ is $(CH_2)_2SO_3$—; M represents a counter ion for balancing electric charge; and m represents a number necessary for balancing electric charge.

6. The silver halide photographic emulsion comprising a methine compound as claimed in claim 1, wherein said silver halide photographic emulsion contains at least one sensitizing dye having different structure from the methine compound represented by formula (I) and having spectral absorption maximum wavelength of from 400 nm to 500 nm.

7. The silver halide photographic emulsion comprising a methine compound as claimed in claim 1, wherein the silver halide grains of said silver halide photographic emulsion have been reduction sensitized.

8. A silver halide photographic material which comprises the silver halide photographic emulsion comprising at least one methine compound represented by the following formula (I):

(I)

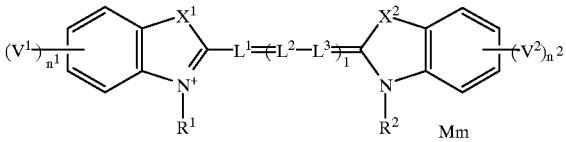

wherein $X^1$ represents a sulfur atom and $X^2$ represents an oxygen atom; one of $V^1$ and $V^2$ represents a chlorine atom and the other represents a phenyl group; $n^1$ and $n^2$ each represents 1; $L^1$, $L^2$ and $L^3$ each represents a methine group; l represents an integer of 0 to 3; M represents a counter ion for balancing electric charge; m represents a necessary number for balancing electric charge; and $R^1$ and $R^2$ each represents an alkyl group represented by any of the following formulae $R_a$, $R_b$, $R_c$, $R_d$ or $R_e$:

$$-(Qa)_r CON^- SO_2 Raa \quad (R_a)$$

$$-(Qb)_s SO_2 N^- COR bb \quad (R_b)$$

$$-(Qc)_t CON^- COR cc \quad (R_c)$$

$$-(Qd)_u SO_2 N^- SO_2 R dd \quad (R_d)$$

$$-(Qe)_v X \quad (R_e)$$

wherein Raa, Rbb, Rcc and Rdd each represents an alkyl group, an aryl group, a heterocyclic group, an alkoxyl group, an aryloxy group, a heterocyclyloxy group, or an amino group; Qa, Qb, Qc, Qd and Qe each represents a divalent linking group; X represents $SO_3^-$, $CO_2^-$, or $PO_3^{2-}$; and r, s, t, u and v each represents an integer of 1 or more, but when X represents $SO_3$—, v represents 1 or 2.

9. The silver halide photographic material as claimed in claim 8, which is a silver halide color negative photographic material.

10. The silver halide photographic material as claimed in claim 1, wherein at least one of $R^1$ and $R^2$ represents an alkyl group represented by formula ($R_a$).

11. The silver halide photographic material as claimed in claim 1, wherein at least one of $R^1$ and $R^2$ represents an alkyl group represented by formula ($R_b$).

12. The silver halide photographic material as claimed in claim 1, wherein at least one of $R^1$ and $R^2$ represents an alkyl group represented by formula ($R_c$).

13. The silver halide photographic material as claimed in claim 1, wherein at least one of $R^1$ and $R^2$ represents an alkyl group represented by formula ($R_d$).

14. The silver halide photographic material as claimed in claim 1, wherein at least one of $R^1$ and $R^2$ represents an alkyl group represented by formula ($R_e$).

* * * * *